US007171944B1

(12) United States Patent
Oono

(10) Patent No.: US 7,171,944 B1
(45) Date of Patent: Feb. 6, 2007

(54) HIGH-PRESSURE FUEL PUMP CONTROL DEVICE FOR INTERNAL COMBUSTION

(75) Inventor: Takahiko Oono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/455,154

(22) Filed: Jun. 19, 2006

(30) Foreign Application Priority Data

Jan. 31, 2006 (JP) ..... 2006-022591

(51) Int. Cl.
*F02M 37/04* (2006.01)

(52) U.S. Cl. ..... 123/357; 123/447

(58) Field of Classification Search ..... 123/357, 123/447, 494, 446, 500, 501, 198 D
See application file for complete search history.

(56) References Cited

U.S. PATENT DOCUMENTS 4,933,863 A * 6/1990 Okano et al. ..... 701/110
5,694,902 A * 12/1997 Miwa et al. ..... 123/493
5,706,654 A * 1/1998 Nagai ..... 60/276
5,785,033 A * 7/1998 Kawamoto et al. ..... 123/520
6,155,232 A * 12/2000 Shibagaki ..... 123/436
6,283,106 B1 * 9/2001 Kadowaki et al. ..... 123/674
6,338,336 B1 * 1/2002 Iida ..... 123/674
6,450,147 B2 * 9/2002 Demura et al. ..... 123/458
6,672,284 B2 * 1/2004 Majima ..... 123/436
6,971,368 B2 * 12/2005 Uchiyama ..... 123/359
2003/0070653 A1 * 4/2003 Ogawa et al. ..... 123/305
2006/0081219 A1 * 4/2006 Nomura et al. ..... 123/458

FOREIGN PATENT DOCUMENTS

JP 06-137199 A 5/1994
JP 2001-263144 A 9/2001

* cited by examiner

*Primary Examiner*—Carl S. Miller
(74) *Attorney, Agent, or Firm*—Sughrue Mion, PLLC

(57) ABSTRACT

A high-pressure fuel pump control device for an internal combustion engine includes a feedback quantity calculating unit (602) for calculating a fuel discharge feedback quantity (QFB) of a high-pressure pump according to a proportional integral operation based on a pressure deviation (ΔPF) between a target pressure (PO) and a fuel pressure (PF), a flow control valve controlling unit (603) for setting drive timing (TD) of a flow control valve (10) on the basis of a target fuel discharge quantity (QO), and an integral operation update prohibiting unit for prohibiting, when the number of times of calculation of the fuel discharge feedback quantity (QFB) reaches a first predetermined number of times while a sign of the pressure deviation (ΔPF) does not invert, update of an integral operand (QFBI), and for resuming, when the sign of the pressure deviation (ΔPF) inverts thereafter, the update of the integral operand (QFBI).

5 Claims, 11 Drawing Sheets

HIGH-PRESSURE FUEL PUMP CONTROL DEVICE FOR INTERNAL COMBUSTION

BACKGROUND OF THE INVENTION

1. Field of the Invention

The present invention relates to a high-pressure fuel pump control device for an internal combustion engine that performs feedback control to adjust a pressure deviation between a target pressure and a fuel pressure in an accumulator, to be zero.

2. Description of the Related Art

In general, an internal combustion engine of a type for directly injecting and supplying fuel into a combustion chamber raises a fuel pressure to a pressure optimum for a combustion state (a target pressure) by pressurizing the fuel supplied to a fuel injection valve with a high-pressure fuel pump.

A high-pressure fuel pump control device for the internal combustion engine of this type calculates a fuel discharge feedback quantity on the basis of a pressure deviation between the target pressure and a fuel pressure in an accumulator detected by a fuel pressure sensor, determines drive timing for a flow control valve on the basis of the fuel discharge feedback quantity, and adjusts a fuel discharge quantity of the high-pressure fuel pump. Accordingly, the fuel pressure in the accumulator is controlled to coincide with the target pressure.

The high-pressure fuel pump control device calculates the fuel discharge feedback quantity used for determination of drive timing of the flow control valve by executing a proportional integral operation or the like based on a pressure deviation between a target pressure set on the basis of an operation state of the internal combustion engine and a fuel pressure in the accumulator detected by the fuel pressure sensor.

Subsequently, the high-pressure fuel pump control device adds up the fuel discharge feedback quantity and a fuel injection quantity of the fuel injected from the fuel injection valve to calculate a target fuel discharge quantity (=fuel discharge feedback quantity+fuel injection quantity) of the high-pressure fuel pump. Further, the high-pressure fuel pump control device converts the target fuel discharge quantity into drive timing for the flow control valve using a drive timing map.

Finally, the high-pressure fuel pump control device drives the flow control valve at the drive timing subjected to the map conversion. Accordingly, a quantity of fuel equivalent to a fuel discharge quantity necessary for causing the fuel pressure in the accumulator to coincide with the target pressure is supplied from the high-pressure fuel pump to the accumulator.

The fuel injection quantity used for calculating the target fuel discharge quantity of the high-pressure fuel pump is a quantity of fuel flowing out from the accumulator when the fuel is injected from the fuel injection valve. The fuel injection quantity is equivalent to a fuel discharge quantity necessary for maintaining the fuel pressure in the accumulator.

The fuel discharge feedback quantity used for calculating the target fuel discharge quantity of the high-pressure fuel pump is equivalent to a fuel discharge quantity necessary for adjusting a pressure deviation between the target pressure and the fuel pressure in the accumulator to be zero. The fuel discharge feedback quantity increases and decreases according to the pressure deviation.

For example, when the pressure deviation is larger than zero (the fuel pressure is lower than the target pressure), since the fuel discharge feedback quantity increases, the fuel discharge quantity of the high-pressure fuel pump increases and the fuel pressure in the accumulator rises.

On the other hand, when the pressure deviation is smaller than zero (the fuel pressure is higher than the target pressure), since the fuel discharge feedback quantity decreases, the fuel discharge quantity of the high-pressure fuel pump decreases and the fuel pressure in the accumulator falls.

In this way, the fuel discharge quantity of the high-pressure pump is subjected to feedback control to adjust the pressure deviation to be zero (make the fuel pressure in the accumulator and the target pressure equal).

When the pressure deviation is larger than zero, it is attempted to raise the fuel pressure in the accumulator to the target pressure by increasing an integral operand in the fuel discharge feedback quantity. However, when a state in which the pressure deviation is larger than zero lasts long, the integral operand increases excessively.

It is known that, when the integral operand increases excessively in this way, a fuel discharge quantity after the fuel pressure in the accumulator has reached the target pressure becomes excessively large, and the fuel pressure in the accumulator rises because it is impossible to maintain the fuel pressure at the target pressure, thereby causing so-called overshoot.

Proposed in view of this is a high-pressure fuel pump control device for an internal combustion engine, which is configured to prohibit update of an integral operand when a fuel discharge quantity of a high-pressure fuel pump rises to a value near a maximum value (see, for example, JP 2001-263144 A).

According to the conventional device described in JP 2001-263144 A, the integral operand is prevented from increasing excessively when a fuel pressure in an accumulator is raised to a target pressure. Thus, the occurrence of overshoot is controlled.

On the other hand, when the pressure deviation is smaller than zero, it is attempted to decrease the fuel pressure in the accumulator to the target pressure by reducing the integral operand in the fuel discharge feedback quantity. However, when a state in which the pressure deviation is smaller than zero lasts long, the integral operand decreases excessively.

It is known that, when the integral operand decreases excessively, a fuel discharge quantity after the fuel pressure in the accumulator has reached the target pressure becomes excessively small, and the fuel pressure falls because it is impossible to maintain the fuel pressure in the accumulator at the target pressure, thereby causing so-called undershoot.

Thus, proposed is a high-pressure fuel pump control device for an internal combustion engine, which is configured to prohibit update of an integral operand when a fuel pressure in an accumulator is higher than a target pressure by a quantity equal to or larger than a predetermined quantity (see, for example, JP 6-137199 A).

According to the conventional device described in JP 6-137199 A, the integral operand is prevented from decreasing excessively when the fuel pressure in the accumulator is decreased to the target pressure. Thus, the occurrence of undershoot is controlled.

In the conventional high-pressure fuel pump control device for an internal combustion engine, for example, in the case of JP 2001-263144 A, the integral operand is prevented from increasing excessively by mistake when the state in which the pressure deviation is larger than zero (the fuel pressure is lower than the target pressure) lasts long. Thus, it is possible to control the occurrence of overshoot after the fuel pressure in the accumulator has reached the target pressure. However, the integral operand continues to increase without update thereof being prohibited until it is judged that the fuel discharge quantity of the high-pressure fuel pump has reached the value near the maximum value. Thus, when the fuel discharge quantity does not reach the value near the maximum value or when it takes long until the fuel discharge quantity reaches the value near the maximum value, prohibition of the increase in the integral operand is delayed, a sufficient effect for controlling overshoot is not obtained, and a combustion state or an exhaust gas is deteriorated.

In the case of JP 6-137199 A, the integral operand is prevented from decreasing excessively when the state in which the pressure deviation is smaller than zero (the fuel pressure is higher than the target pressure) lasts long. Thus, it is possible to control the occurrence of undershoot after the fuel pressure in the accumulator has reached the target pressure. However, the integral operand continues to decrease without update thereof being prohibited until it is judged that the fuel pressure in the accumulator has reached a value higher than the target value by a quantity equal to or larger than the predetermined quantity. Thus, when the fuel pressure in the accumulator does not reach the value higher than the target value by the quantity equal to or larger than the predetermined quantity or when it takes long until the fuel pressure in the accumulator reaches the value higher than the target value by the quantity equal to or larger than the predetermined quantity, prohibition of the decrease in the integral operand is delayed, a sufficient effect for controlling overshoot is not obtained, and a combustion state or an exhaust gas is deteriorated.

Moreover, in both the cases of JP 2001-263144 A and JP 6-137199 A, when a value of the integral operand at a point when update of the integral operand is prohibited is a value inappropriate for an operation state at the time when the update of the integral operand is resumed, overshoot or undershoot of the fuel pressure occurs when the update of the integral operand is resumed. This causes deterioration in a combustion state or an exhaust gas.

SUMMARY OF THE INVENTION

The present invention has been made to solve the problems, and it is therefore an object of the invention to obtain a control device for a high-pressure fuel pump in which deterioration in a combustion state or an exhaust gas is prevented by surely preventing, at the time of feedback control for adjusting a pressure deviation between a target pressure and a fuel pressure in an accumulator to be zero, an integral operand from increasing or decreasing excessively and preventing occurrence of overshoot or undershoot of a fuel pressure due to prohibition of update of the integral operand at the time when a value of the integral operand is inappropriate.

According to the present invention, there is provided a high-pressure fuel pump control device for an internal combustion engine, including:

various sensors for detecting an operation state of an internal combustion engine;

a high-pressure fuel pump for pressurizing and discharging low-pressure fuel, which has been sucked;

a flow control valve for adjusting a quantity of fuel discharged from the high-pressure fuel pump when drive timing is set;

an accumulator for accumulating a pressure of the fuel discharged from the high-pressure fuel pump;

fuel injection valves for injecting and supplying the fuel in the accumulator to respective combustion chambers of the internal combustion engine;

a fuel pressure sensor for detecting a fuel pressure in the accumulator;

target pressure setting means for setting a target pressure in the accumulator on the basis of the operation state;

feedback quantity calculating means for calculating a fuel discharge feedback quantity of the high-pressure fuel pump according to a proportional integral operation based on a pressure deviation between the target pressure and the fuel pressure detected by the fuel pressure sensor;

flow control valve controlling means for setting the drive timing of the flow control valve on the basis of a target fuel discharge quantity calculated by adding up a fuel injection quantity of the fuel injected from the fuel injection valve and the fuel discharge feedback quantity; and integral operation update prohibiting means, in which the integral operation update prohibiting means prohibits, when a number of times of calculation of the fuel discharge feedback quantity reaches a first predetermined number of times while a sign of the pressure deviation does not invert, update of an integral operand in the fuel discharge feedback quantity, and resumes, when the sign of the pressure deviation inverts after that, the update of the integral operand.

According to the present invention, it is possible to quickly prevent, at the time of feedback control for a fuel pressure, an integral operand in a fuel discharge feedback quantity from increasing or decreasing excessively and prevent update of the integral operand from being prohibited when the integral operand is an inappropriate value. This makes it possible to control overshoot or undershoot of a fuel pressure and surely prevent deterioration in a combustion state or an exhaust gas.

DETAILED DESCRIPTION OF THE PREFERRED EMBODIMENTS

First Embodiment

A first embodiment of the present invention will be hereinafter explained in detail with reference to the accompanying drawings.

Figure 1:
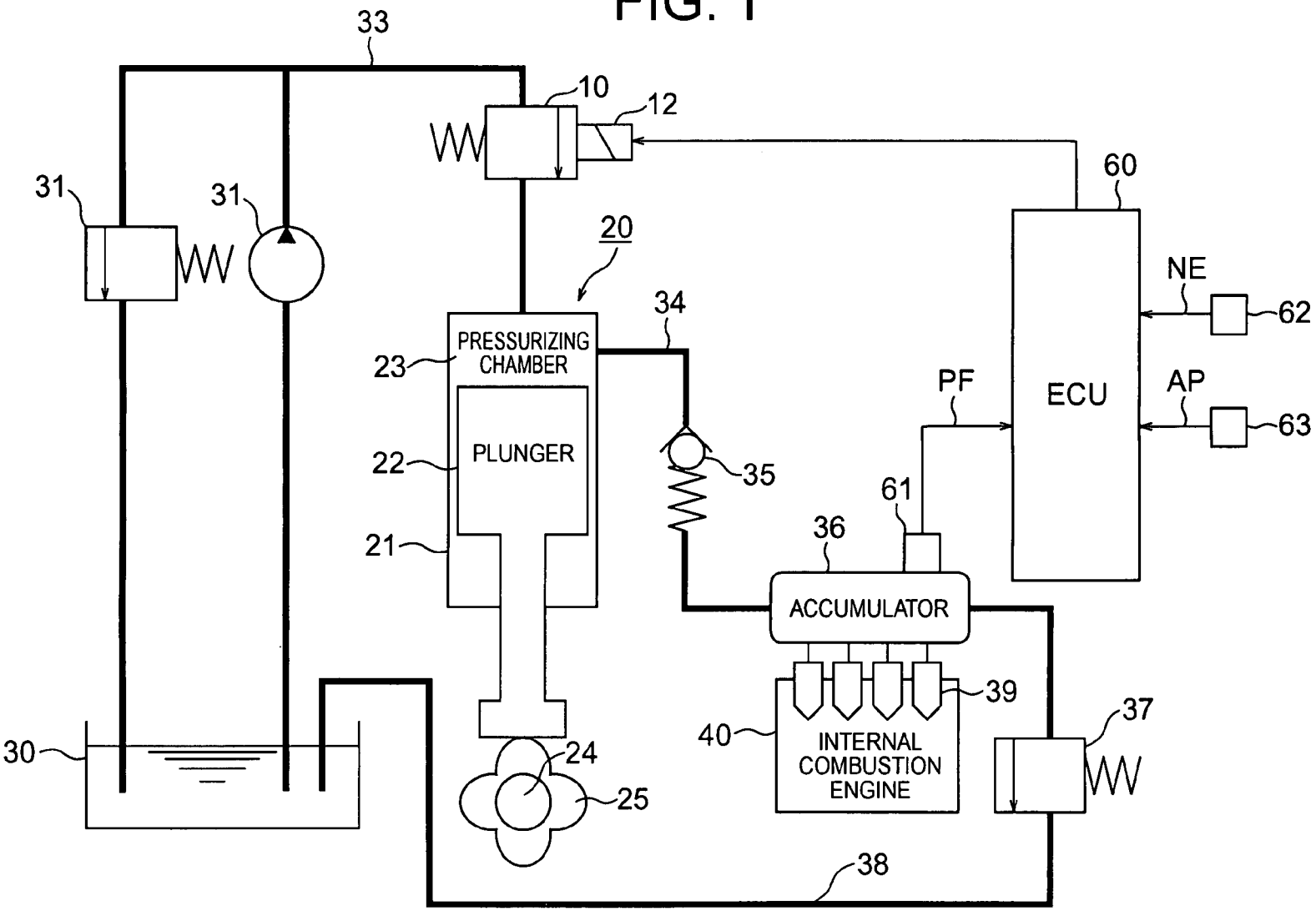
FIG. 1 is a block diagram schematically showing a high-pressure fuel pump control device for an internal combustion engine according to first to third embodiments of the present invention.

FIG. 1 is a block diagram schematically showing a high-pressure fuel pump control device for an internal combustion engine according to the invention.

In FIG. 1, the high-pressure fuel pump control device for an internal combustion engine includes, as a fuel supply system, a normally open flow control valve 10 that has a solenoid 12, a high-pressure fuel pump 20 that has a cylinder 21, a plunger 22, and a pressurizing chamber 23, a cam shaft 24 that has a pump cam 25, a fuel tank 30 having fuel filled therein, a low-pressure path 33 having two branches connected to the fuel tank 30 respectively via a low-pressure fuel pump 31 and a low-pressure regulator 32, a high-pressure path (a discharge path) 34 connected to the pressurizing chamber 23 of the high-pressure fuel pump 20, an accumulator 36 connected to the high-pressure path 34 via a discharge valve (a check valve) 35, a relief path 38 that connects the accumulator 36 and the fuel tank 30 via a relief valve 37, and fuel injection valves 39 that inject and supply the fuel stored in the accumulator 36 to respective combustion chambers of an internal combustion engine 40.

The high-pressure fuel pump control device includes, as a control system, an ECU 60 that controls energization (valve close of the flow control valve 10) drive timing for the solenoid 12 of the flow control valve 10 consisting of an electromagnetic valve.

As described later, the ECU 60 includes target pressure setting means, feedback quantity calculating means, flow control valve controlling means, feedback state judging means, integral operation update prohibiting means, and fuel injection quantity calculating means. Detection signals from various sensors such as a fuel pressure sensor 61, a crank angle sensor 62, and an accelerator position sensor 63 are inputted to the ECU 60 as operation information of the internal combustion engine 40.

The low-pressure fuel pump 31 lifts the fuel in the fuel tank 30 and discharges the fuel to the low-pressure path 33. The high-pressure fuel pump 20 sucks the fuel discharged from the low-pressure fuel pump 31 into the pressurizing chamber 23 and discharges the fuel.

The low-pressure path 33 is connected to an upstream side of the pressurizing chamber 23 in the high-pressure fuel pump 20 via the flow control valve 10. In other words, the flow control valve 10 is arranged in a fuel path that connects the low-pressure path 33 and the pressurizing chamber 23.

The discharge valve 35 is arranged in the high-pressure path 34 that connects the pressurizing chamber 23 and the accumulator 36.

The fuel injection valves 39 directly inject and supply the high-pressure fuel in the accumulator 36 into the respective fuel chambers provided for each cylinder of the internal combustion engine 40.

The fuel sensor 61 detects a fuel pressure PF in the accumulator 36 and outputs the fuel pressure PF to the ECU 60.

On the low-pressure path 33 side of the fuel supply system, the fuel discharged from the low-pressure fuel pump 31 is adjusted to have a predetermined low-pressure value by the low-pressure regulator 32. When the plunger 22 moves down in the cylinder 21, the fuel is led into the pressurizing chamber 23 through the flow control valve 10.

The plunger 22 in the high-pressure fuel pump 20 reciprocatingly moves in the cylinder 21 in synchronization with the rotation of the internal combustion engine 40. Accordingly, the high-pressure fuel pump 20 sucks the fuel into the pressurizing chamber 23 from the low-pressure path 33 via the flow control valve 10 during a period in which the plunger 22 moves down. The high-pressure fuel pump 20 pressurizes the fuel in the pressurizing chamber 23 to have a high pressure and supplies the fuel to the accumulator 36 via the discharge valve 35 while the flow control valve 10 is driven to close during a period in which the plunger 22 moves up.

The pressurizing chamber 23 is partitioned and formed by the internal peripheral wall surface of the cylinder 21 and the upper end surface of the plunger 22.

The lower end of the plunger 22 is brought into pressurized contact with the pump cam 25 provided in the cam shaft 24 of the internal combustion engine 40. When the pump cam 25 rotates in association with the rotation of the cam shaft 24, the plunger 22 reciprocatingly moves in the cylinder 21 to increase and decrease a capacity in the pressurizing chamber 23.

The high-pressure path 34 connected to the downstream side of the pressurizing chamber 23 is connected to the accumulator 36 via the discharge valve 35 consisting of the check valve that allows only a flow of the fuel from the pressurizing chamber 23 to the accumulator 36.

The accumulator 36 stores and holds the high-pressure fuel discharged from the pressurizing chamber 23. The accumulator 36 is commonly connected to the respective fuel injection valves 39 of the internal combustion engine 40 and distributes the high-pressure fuel stored therein to the fuel injection valves 39.

The relief valve 37 connected to the accumulator 36 consists of a normally closed valve that opens when a fuel pressure is equal to or higher than a predetermined fuel pressure (a valve opening pressure set value). The relief valve 37 opens when a fuel pressure in the accumulator 36 is about to rise to a pressure equal to or higher than the valve opening pressure set value. Accordingly, the fuel in the accumulator 36, a pressure of which is about to rise to a pressure equal to or higher than the valve opening pressure set value, is returned to the fuel tank 30 through the relieve path 38. Thus, the fuel pressure in the accumulator 36 never rises excessively.

Valve close (energization of the solenoid 12) drive timing of the flow control valve 10, which is provided in the low-pressure path 33 connecting the low-pressure fuel pump 31 and the pressurizing chamber 23, is controlled under the control by the ECU 60. The flow control valve 10 adjusts a fuel discharge quantity from the high-pressure fuel pump 20 to the accumulator 36.

In the high-pressure fuel pump 20, when the plunger 22 moves up in the cylinder 21 (the capacity of the pressurizing chamber 23 decreases), the fuel, which has been sucked into the pressurizing chamber 23 is returned to the low-pressure path 33 from the pressurizing chamber 23 via the flow control valve 10 while flow control valve 10 is subjected to valve opening (deenergization of the solenoid 12). Thus, the high-pressure fuel is never supplied to the accumulator 36.

On the other hand, after the flow control valve 10 is closed at predetermined timing while the plunger 22 is moving up in the cylinder 21, the fuel pressurized in the pressurizing chamber 23 is discharged to the discharge path 34 and supplied to the accumulator 36 through the discharge valve 35.

The ECU 60 captures the fuel pressure PF in the accumulator 36 detected by the fuel pressure sensor 61, engine speed NE of the internal combustion engine 40 detected by the crank angle sensor 62, a step-in quantity AP of an acceleration pedal (not shown) detected by the accelerator position sensor 63 as various kinds of operation state information.

The ECU 60 determines a target pressure PO on the basis of the engine speed NE detected by the crank angle sensor 62 and the acceleration pedal step-in quantity AP detected by the accelerator position sensor 63, calculates a target fuel discharge quantity QO necessary for causing the fuel pressure PF in the accumulator 36 to coincide with the target pressure PO, sets valve closing drive timing TD for the flow control valve 10 (energization drive timing for the solenoid 12) according to the target fuel discharge quantity QO, and controls a fuel quantity of fuel discharged to the accumulator 36 from the high-pressure fuel pump 20.

A specific constitution for realizing a control function of the ECU 60 according the invention will be explained with reference to a functional block diagram in FIG. 2.

Figure 2:
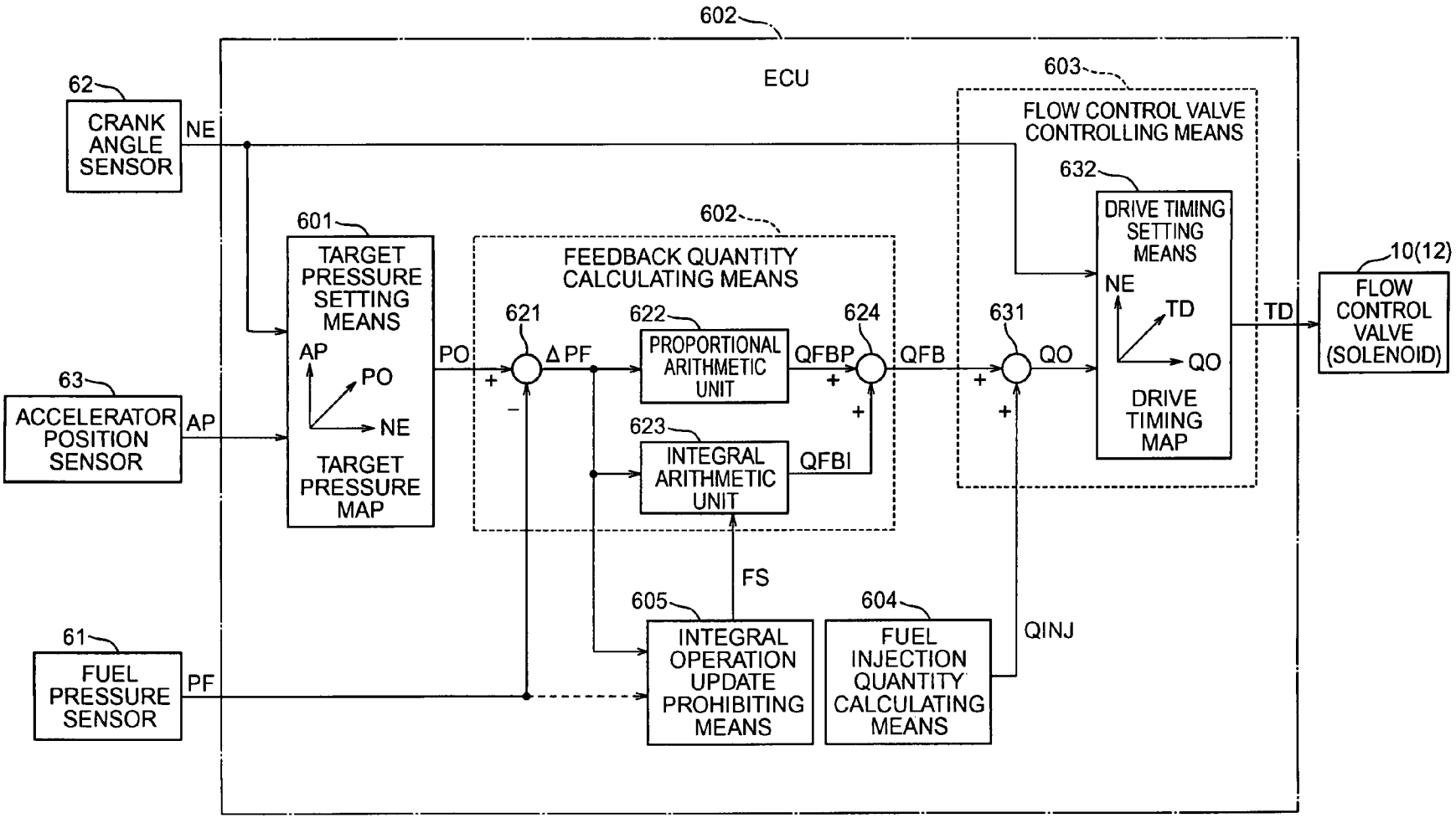
FIG. 2 is a block diagram specifically showing an ECU in the high-pressure fuel pump control device for an internal combustion engine according to the first to the third embodiments.

FIG. 2 shows a functional constitution of the ECU 60. Components 10, 12, and 61 to 63 related to those in FIG. 1 are denoted by the identical reference numerals and detailed explanations of the components are omitted.

In FIG. 2, the fuel pressure sensor 61 that detects the fuel pressure PF in the accumulator 36, the crank angle sensor 62 that detects the engine speed NE of the internal combustion engine 40, and the accelerator position sensor 63 that detects the accelerator pedal step-in quantity AP are connected to the ECU 60.

The ECU 60 controls valve close (energization of the solenoid 12) drive timing for the flow control valve 10 on the basis of detection information of the various sensors including the sensor means 61 to 63.

The ECU 60 includes target pressure setting means 601 including a target pressure map, feedback quantity calculating means 602, flow control valve controlling means 603, and integral operation update prohibiting means 605.

Although not explained in detail, the ECU 60 also functions as control means for the internal combustion engine. The ECU 60 includes fuel injection quantity calculating means 604 that calculates a fuel injection quantity QINJ of fuel injected from the fuel injection valves 39. The ECU 60 also includes means (not shown) for subjecting various actuators such as the fuel injection valves 39 and an ignition coil (not shown) to driving control.

The feedback quantity calculating means 602 includes a subtracter 621 that calculates a pressure deviation ΔPF between the target pressure PO and the detected fuel pressure PF, a proportional arithmetic unit 622 and an integral arithmetic unit 623 that use the pressure deviation ΔPF, and an adder 624 that adds up a proportional operand QFBP and an integral operand QFBI to calculate a fuel discharge feedback quantity QFB.

The flow control valve controlling means 603 includes an adder 631 that adds up the fuel discharge feedback quantity QFB and the fuel injection quantity QINJ to calculate the target fuel discharge quantity QO and drive timing setting means 632 for setting the drive timing TD using the engine speed NE and the target fuel injection quantity QO. The drive timing setting means 632 includes a drive timing map.

In the ECU 60, the engine speed NE of the internal combustion engine 40 detected by the crank angle sensor 62 and the accelerator pedal step-in quantity AP detected by the accelerator position sensor 63 are inputted to the target pressure setting means 601.

The target pressure setting means 601 sets the target pressure PO in the accumulator 36 according to a target pressure map calculation based on the engine speed NE and the accelerator pedal step-in quantity AP and inputs the target pressure PO to the feedback quantity calculating means 602.

The subtracter 621 in the feedback quantity calculating means 602 calculates, with the target pressure PO and the fuel pressure PF in the accumulator 36 detected by the fuel pressure sensor 61 as input information, a pressure deviation ΔPF (=PO−PF) between the target pressure PO and the fuel pressure PF and inputs the pressure deviation ΔPF to the proportional arithmetic unit 622 and the integral arithmetic unit 623.

The proportional arithmetic unit 622 and the integral arithmetic unit 623 execute a proportional operation and an integral operation based on the pressure deviation ΔPF and calculates the proportional operand QFBP and the integral operand QFBI.

Subsequently, the adder 624 adds up the proportional operand QFBP and the integral operand QFBI, calculates the fuel discharge feedback quantity QFB (=QFBP+QFBI) of the high-pressure fuel pump 20, and inputs the fuel discharge feedback quantity QFB to the adder 631 in the flow control valve controlling means 603.

On the other hand, the fuel injection quantity calculating means 604 calculates the fuel injection quantity QINJ of the fuel injected from the fuel injection valves 39 and inputs the fuel injection quantity QINJ to the adder 631 in the flow control valve controlling means 603.

The proportional operand QFBP calculated by the proportional arithmetic unit 622 in the feedback quantity calculating means 602 is calculated, for example, as indicated by the following Expression (1) on the basis of the pressure deviation ΔPF.

$$QFBP=\Delta PF\times KP \tag{1}$$

In Expression (1), KP is a proportional coefficient.

When PO is larger than PF (a sign of the pressure deviation ΔPF is "+(plus)"), the proportional operand QFBP takes a positive value proportional to the pressure deviation ΔPF. Conversely, when PO is smaller than PF (a sign of the pressure deviation ΔPF is "−(minus)"), the proportional operand takes a negative value proportional to the pressure deviation ΔPF.

The integral operand QFBI calculated by the integral arithmetic unit 623 in the feedback quantity calculating means 602 is calculated, for example, as indicated by the following Expression (2) or (3) that is selected according to a sign ("+" or "−") of the pressure deviation ΔPF.

When the pressure deviation ΔPF is equal to or larger than zero (the sign is "+" or ΔPF=0), $$QFBI=QFBI(\text{last value})+KI \tag{2}$$

When the pressure deviation ΔPF is smaller than zero (the sign is "−"), $$QFBI=QFBI(\text{last value})-KI \tag{3}$$

In Expressions (2) and (3), KI is an integral coefficient.

When PO is equal to or larger than PF (a sign of the pressure deviation ΔPF is "+(plus)" or ΔPF=0), the integral operand QFBI takes a value larger by the integral coefficient KI according to Expression (2). Conversely, when PO is smaller than PF (a sign of the pressure deviation ΔPF is "−(minus)"), the integral operand takes a value smaller by the integral coefficient KI according to Expression (3).

The pressure deviation ΔPF calculated by the subtracter 621 in the feedback quantity calculating means 602 is also outputted to the integral operation update prohibiting means 605.

When an update prohibition request for the integral operand QFBI is received from the integral operation update prohibiting means 605, or when an integral operation update prohibition flag FS=1 is inputted, the integral arithmetic unit 623 in the feedback quantity calculating means 602 prohibits update of the integral operand QFBI and holds the last value of the integral operand QFBI.

In the flow control valve controlling means 603, the adder 631 adds up the fuel discharge feedback quantity QFB and the fuel injection quantity QINJ calculated by the fuel injection quantity calculating means 604 to calculate the target fuel discharge quantity QO (=QFB+QINJ) and inputs the target fuel discharge quantity QO to the flow control valve controlling means 603.

The flow control valve controlling means 603 determines, with the target fuel discharge quantity QO and the engine speed NE as input information, the drive timing for the flow control valve 10 (energization timing of the solenoid 12) TD and outputs the drive timing TD to the flow control valve 10 (the solenoid 12).

In the flow control valve 10, the solenoid 12 is energized such that the flow control valve 10 is driven to close at the driving timing TD determined by the flow control valve controlling means 603.

As a result, as described above, the fuel equivalent to the target fuel discharge quantity QO is supplied into the accumulator 36 from the high-pressure fuel pump 20. The fuel pressure PF in the accumulator 36 is controlled to coincide with the target pressure PO.

A functional operation of the integral operation update prohibiting means 605, which is a characteristic part of the first embodiment, will be specifically explained.

It is assumed that arithmetic processing of the integral operation update prohibiting means 605 is executed in a control period identical with that of the feedback quantity calculating means 602.

When the number of times of arithmetic processing has reached a first predetermined number of times while a sign of the pressure deviation ΔPF inputted from the feedback quantity calculating means 602 does not invert, the integral operation update prohibiting means 605 sets the integral operation update prohibition flag FS to "1". After the integral operation update prohibiting flag FS is set to "1", when the inversion of the sign of the pressure deviation ΔPF is detected, the integral operation update prohibiting means 605 resets the integral operation update prohibition flag FS to "0".

As indicated by a broken line arrow in FIG. 2, a detection value of the fuel pressure PF can also be inputted to the integral operation update prohibiting means 605 (see a third embodiment described later).

The integral operation update prohibition flag FS is inputted to the integral arithmetic unit 623 in the feedback quantity calculating means 602. Over a period in which the integral operation update prohibition flag FS is held at 1, the integral operation update prohibition flag FS prohibits update of the integral operand QFBI and holds the last value of the integral operand QFBI.

An operation for setting the integral operation update prohibition flag FS in the integral operand 623 from the integral operation update prohibiting means 605 and a control operation by the integral arithmetic unit 623 will be hereinafter explained with reference to a timing chart in FIG. 3 together with FIGS. 1 and 2.

Figure 3:
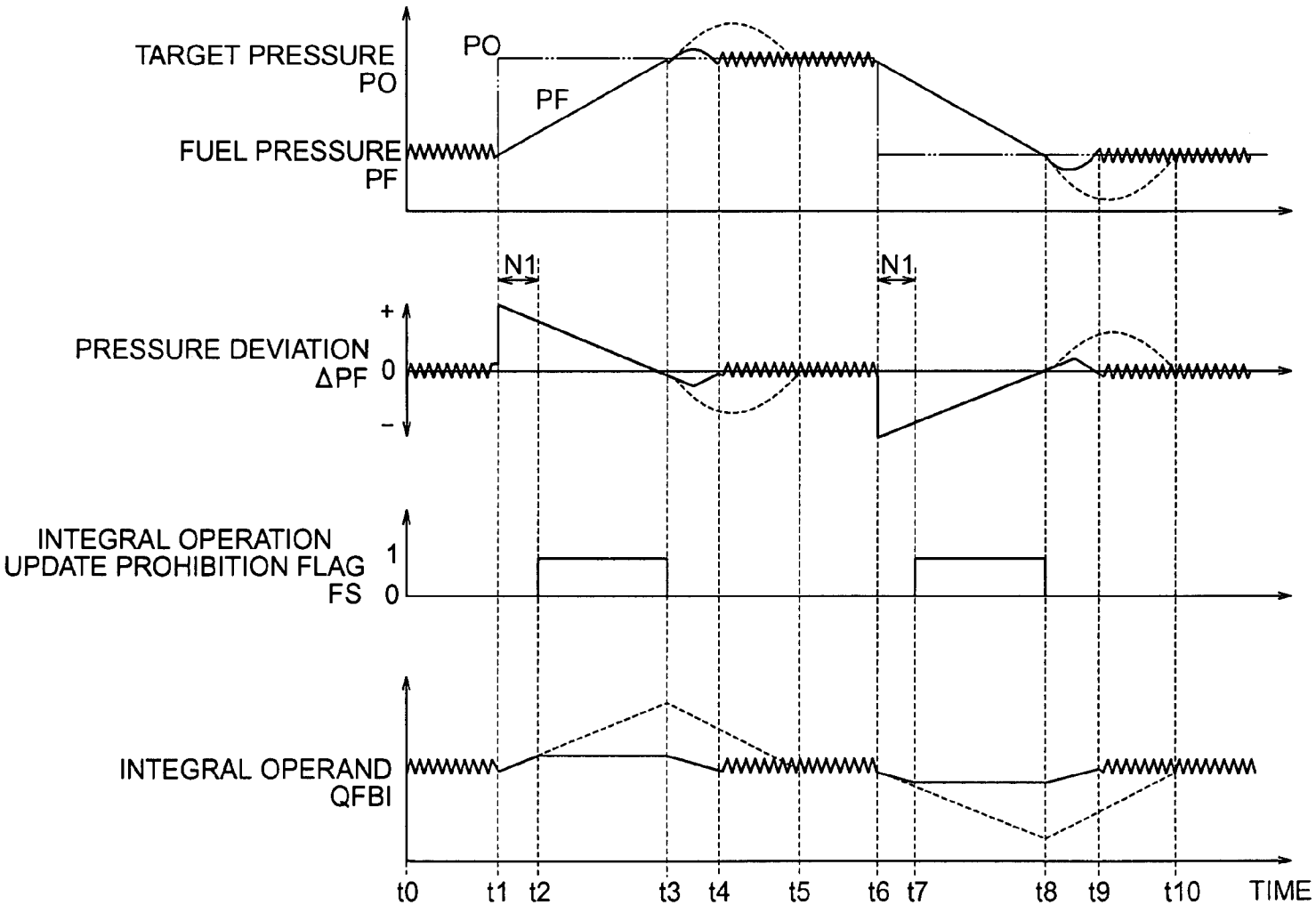
FIG. 3 is a timing chart for explaining a control operation according to the first embodiment.

In FIG. 3, the abscissa indicates elapse of time. Signs t0 to t10 are affixed only to time positions that are key positions of the movements.

Periods N1 indicated by the time t1 to t2 and the time t6 to t7 indicate time required for executing the arithmetic operation for the fuel discharge feedback quantity QFB by the first predetermined number of times K1.

The ordinates in FIG. 3 indicate, in order from the one at the top, control states of the target pressure PO (an alternate long and two short dashes line) and the fuel pressure PF (a solid line), the pressure deviation ΔPF (=PO−PF), the integral operation update prohibition flag FS, and the integral operand QFBI.

Concerning the fuel pressure PF, the pressure deviation ΔPF, and the integral operand QFBI in FIG. 3, movements at the time when the first embodiment is applied thereto are indicated by solid lines. Movements at the time when the first embodiment is not applied thereto are indicated by dotted lines.

First, in a period of the time t0 to t1 in FIG. 3, the fuel pressure PF is properly subjected to feedback control in a state in which the fuel pressure PF substantially coincides with the target pressure PO. Thus, a sign of the pressure deviation ΔPF (=PO-PF) repeats inversion of "+" and "−" in synchronization with the feedback control.

The integral operand QFBI is calculated by switching Expressions (2) and (3) in synchronization with the inversion of the sign of the pressure deviation ΔPF. In this state, the number of times of calculation for the fuel discharge feedback quantity QFB never reaches the first predetermined number of times K1 while the sign of the pressure deviation ΔPF does not invert.

Therefore, the integral operation update prohibition flag FS is never set to "1" in the period of the time t0 to t1.

At the time t1, since the target pressure PO is changed to a large value, a large pressure deviation ΔPF with the "+sign" occurs between the changed target pressure PO and the detected fuel pressure PF. Therefore, immediately after the time t1, a state in which the pressure deviation ΔPF indicates the "+sign" lasts for a while.

At this point, if the first embodiment is not applied, Expression (2) is continuously selected as the arithmetic processing for the integral operand QFBI by the integral arithmetic unit 623 until the fuel pressure PF rises to reach the target pressure PO (i.e., until the sign of the pressure deviation ΔPF changes to the "−sign").

Therefore, the integral operand QFBI continues an excessive increase as indicated by a dotted line in FIG. 3 over a period of the time t1 to t3. After the fuel pressure PF rises to reach the target pressure PO (i.e., the pressure deviation ΔPF falls to below "0" and the sign of the pressure deviation ΔPF changes to the "−sign"), the fuel pressure PF exceeds the target pressure PO and starts overshoot (see a dotted line immediately after the time t3).

During occurrence of such overshoot (see the dotted line in FIG. 3), since the fuel pressure PF is higher than the target pressure PO, the sign of the pressure deviation ΔPF (=PO−

PF) is changed to the "−sign". In the arithmetic processing for the integral operand QFBI, Expression (3) is continuously selected.

Therefore, the integral operand QFBI decreases and, at the time t5, reaches a correct value at last (see movements of the fuel pressure PF, the pressure deviation ΔPF, and the integral operand QFBI indicated by dotted lines in a period of the time t3 to t5).

On the other hand, when the first embodiment is applied, immediately after the time t1 when the target pressure PO is changed to the large value, as described above, the sign of the pressure deviation ΔPF is changed to the "+sign" and Expression (2) is selected as arithmetic processing for the integral operand QFBI. Thus, the integral operand QFBI starts to increase. However, at a point (the time t2) when it is judged that the number of times of calculation of the fuel discharge feedback quantity QFB has reached the first predetermined number of times K1 (in terms of time, the period N1 has elapsed) while the sign of the pressure deviation ΔPF does not invert from the "+sign" to the "−sign", the integral operation update prohibition flag FS is set to "1". Thus, update of the integral operand QFBI is prohibited.

As a result, update of the integral operand QFBI is prohibited and a value at the point of the time t2 is held over a period from the time when update of the integral operand QFBI is prohibited until the time when the fuel pressure PF rises to reach the target pressure PO (i.e., the sign of the pressure deviation ΔPF changes to the "−sign") (see movements of the fuel pressure PF, the pressure deviation ΔPF, and the integral operand QFBI indicated by solid lines in a period of the time t2 to t3).

Subsequently, at a point (the time t3) when the pressure deviation ΔPF falls below "0" and the sign of the pressure deviation ΔPF is changed to the "−sign", since the integral operation update prohibition flag FS is reset to "0", update of the integral operand QFBI is resumed.

Therefore, since the integral operand QFBI never increases excessively, large overshoot never occurs after the fuel pressure PF rises to reach the target pressure PO. The integral operand QFBI quickly returns to a proper value (see movements of the fuel pressure PF, the pressure deviation ΔPF, and the integral operand QFBI indicated by solid lines in a period of time t3 to t4).

Subsequently, in a period of the time t5 to t6 in FIG. 3, as in the period of the time t0 to t1, the fuel pressure PF is properly subjected to feedback control in a state in which the fuel pressure PF substantially coincides with the target pressure PO. Thus, the sign of the pressure deviation ΔPF (=PO-PF) repeats the inversion of "+" and "−" in synchronization with the feedback control.

The integral operand QFBI is calculated by switching Expressions (2) and (3) in synchronization with the inversion of the sign of the pressure deviation ΔPF. In this state, the number of times of calculation of the fuel discharge feedback quantity QFB never reaches the first predetermined number of times K1 while the sign of the pressure deviation ΔPF does not invert.

Therefore, the integral operation update prohibition flag FS is never set to "1" in the period of the time t5 to t6.

However, at a point of the time t6, since the target pressure PO is changed to a small value, a large pressure deviation ΔPF with the "−sign" occurs between the changed target pressure PO and the fuel pressure PF.

Therefore, immediately after the time t6, a state in which the pressure deviation ΔPF indicates the "−sign" lasts for a while.

If the first embodiment is not applied, Expression (3) is continuously selected as the arithmetic processing for the integral operand QFBI until the fuel pressure PF falls to reach the target pressure PO (the time t6 to t8) (i.e., the sign of the pressure deviation ΔPF changes to the "+sign"). Thus, the integral operand QFBI continues an excessive decrease as indicated by a dotted line in FIG. 3. After the fuel pressure PF falls to reach the target pressure PO (i.e., the pressure deviation ΔPF exceeds "0" and the sign of the pressure deviation ΔPF changes to the "+sign"), the fuel pressure PF falls below the target pressure PO and starts undershoot (see the fuel pressure PF indicated by a dotted line immediately after the time t8).

In this case, during occurrence of undershoot immediately after the time t8, since the fuel pressure PF is lower than the target pressure PO, the sign of the pressure deviation ΔPF changes to the "+sign" and Expression (2) is continuously selected as arithmetic processing for the integral operand QFBI. Thus, the integral operand QFBI increases to reach a correct value at a point of the time t10 at last (see movements of the fuel pressure PF, the pressure deviation ΔPF, and the integral operand QFBI indicated by dotted lines in a period of the time t8 to t10).

On the other hand, when the first embodiment is applied, immediately after the time t6 when the target pressure PO is changed to a small value, the sign of the pressure deviation ΔPF changes to the "−sign" and Expression (3) is selected as arithmetic processing for the integral operand QFBI. Thus, although the integral operand QFBI starts to decrease, at a point (the time t7) when it is judged that the number of times of calculation of the fuel discharge feedback quantity QFB has reached the first predetermined number of times K1 (in terms of time, the period N1 has elapsed) while the sign of the pressure deviation ΔPF does not invert from the "−sign" to the "+sign", the integral operation update prohibition flag FS is set to "1". Therefore, update of the integral operand QFBI is prohibited.

As a result, update of the integral operand QFBI is prohibited over a period of the time t7 to t8 from the point (the time t6) when update of the integral operand QFBI is first prohibited until the fuel pressure PF falls to reach the target pressure PO (i.e., a period until the pressure deviation ΔPF changes to the "+sign"). The integral operand QFBI is held at a value at the point of the time t7 (see movements of the fuel pressure PF, the pressure deviation ΔPF, and the integral operand QFBI indicated by solid lines in FIG. 3).

Subsequently, at a point (the time t8) when the pressure deviation ΔPF rises above "0" and the sign of the pressure deviation ΔPF changes to the "+sign", the integral operation update prohibition flag FS is reset to "0". Thus, update of the integral operand QFBI is resumed.

In this way, when the first embodiment is applied, the integral operand QFBI never decreases excessively, large undershoot never occurs after the time t8 when the fuel pressure PF falls to reach the target pressure PO, and the integral operand QFBI quickly reaches a proper value (see movements of the fuel pressure PF, the pressure deviation ΔPF, and the integral operand QFBI indicated by solid lines in a period of the time t8 to t9).

A basic control operation by the ECU 60 according to the first embodiment shown in FIG. 2 will be explained with reference to a flowchart in FIG. 4.

Figure 4:
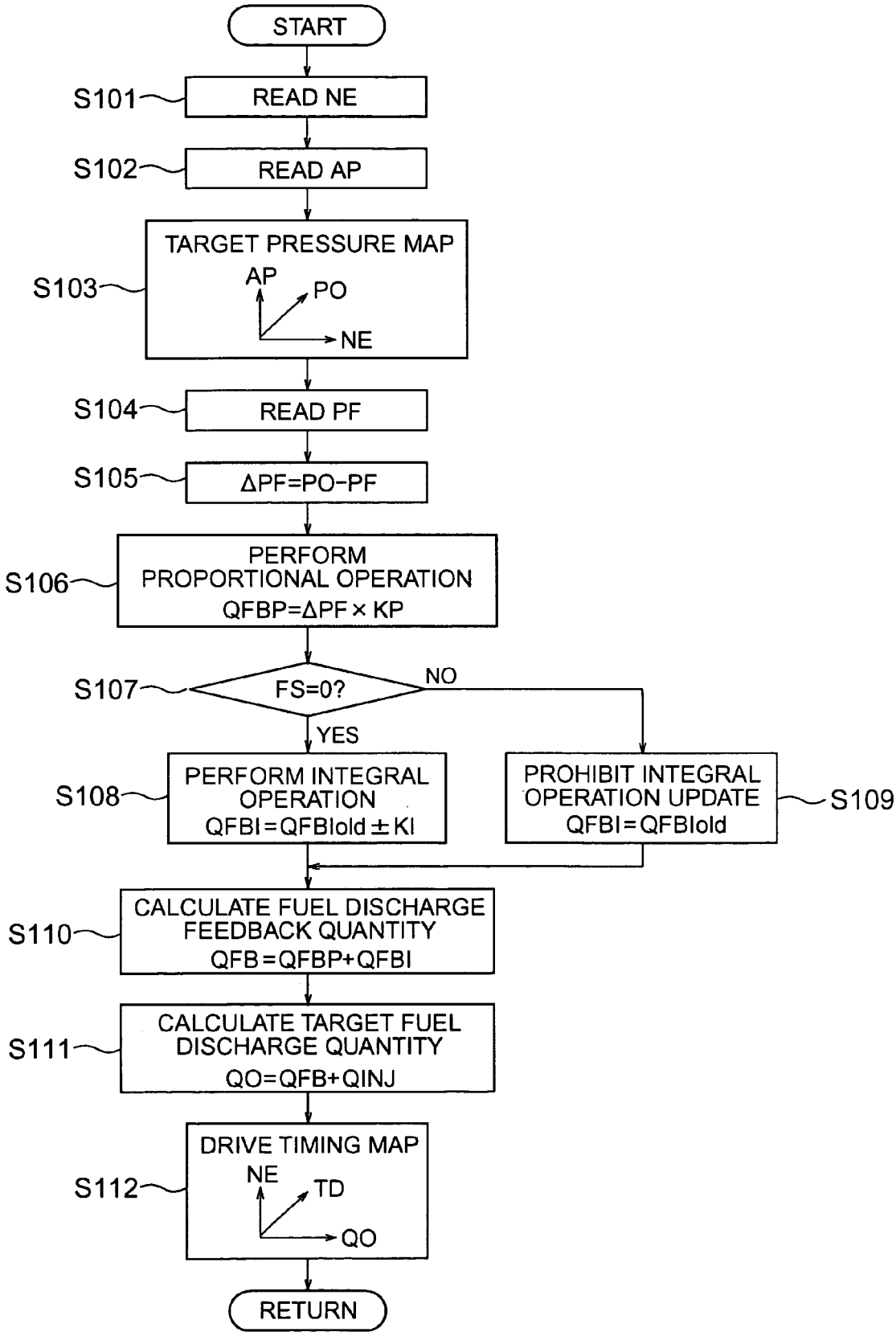
FIG. 4 is a flowchart showing the control operation according to the first embodiment.

In FIG. 4, first, the ECU 60 reads the engine speed NE detected by the crank angle sensor 62 (Step S101). The ECU 60 next reads the acceleration pedal step-in quantity AP detected by the accelerator position sensor 63 (Step S102). The ECU 60 then determines the target pressure PO corresponding to the engine speed NE and the accelerator pedal step-in quantity AP with the target pressure setting means (the target pressure map) 601 (Step S103).

Subsequently, the ECU 60 reads the fuel pressure PF in the accumulator 36 detected by the fuel pressure sensor 61 (Step S104). The ECU 60 then calculates the pressure deviation ΔPF (=PO-PF) with the subtracter 621 in the feedback quantity calculating means 602 (Step S105).

The ECU 60 performs, on the basis of the pressure deviation ΔPF, a proportional operation with Expression (1) and calculates the proportional operand QFBP with the proportional arithmetic unit 622 (Step S106).

The ECU 60 judges whether the integral operation update prohibition flag FS is in a state of "0" (reset) (Step S107). Specific setting processing for the integral operation update prohibition flag FS will be described later (see FIG. 5).

If it is judged in Step S107 that the integral operation update prohibition flag FS is 0 (i.e., "YES" in Step S107), the ECU 60 performs, on the basis of the pressure deviation ΔPF, an integral operation with Expression (2) or (3) and updates the integral operand QFBI (Step S108).

On the other hand, when it is judged in Step S107 that the integral operation update prohibition flag FS is 1 (i.e., "NO" in Step S107), the ECU 60 prohibits update of the integral operand QFBI and holds a present value of the integral operand QFBI at the last value of the integral operand QFBIold (QFBI=QFBIold) (Step S109).

The ECU 60 adds up the proportional operand QFBP and the integral operand QFBI with the adder 624 to calculate the fuel discharge feedback quantity QFB (=QFBP+QFBI) (Step S110). The ECU 60 adds up the fuel discharge feedback quantity QFB and the fuel injection quantity QINJ with the adder 631 in the flow control valve controlling means 603 to calculate the target fuel discharge quantity QO (=QFB+QINJ) (Step S111).

The ECU 60 sets, on the basis of the target fuel discharge quantity QO and the engine speed NE, the drive timing TD for the flow control valve 10 using the drive timing map with the drive timing setting means 632 (Step S112) and exits from the processing routine of FIG. 4.

In the flow control valve 10, the solenoid is controlled to be energized such that the flow control valve 10 is driven to close according to the drive timing TD.

Processing for setting the integral operation update prohibition flag FS (used in the judging step S107) by the integral operation update prohibiting means 605 in the ECU 60 will be specifically explained with reference to a flowchart in FIG. 5.

The integral operation update prohibiting means 605 has a counter C1 for measuring the duration of a state in which the sign of the pressure deviation ΔPF does not invert (corresponding to the number of times of calculation K1).

Figure 5:
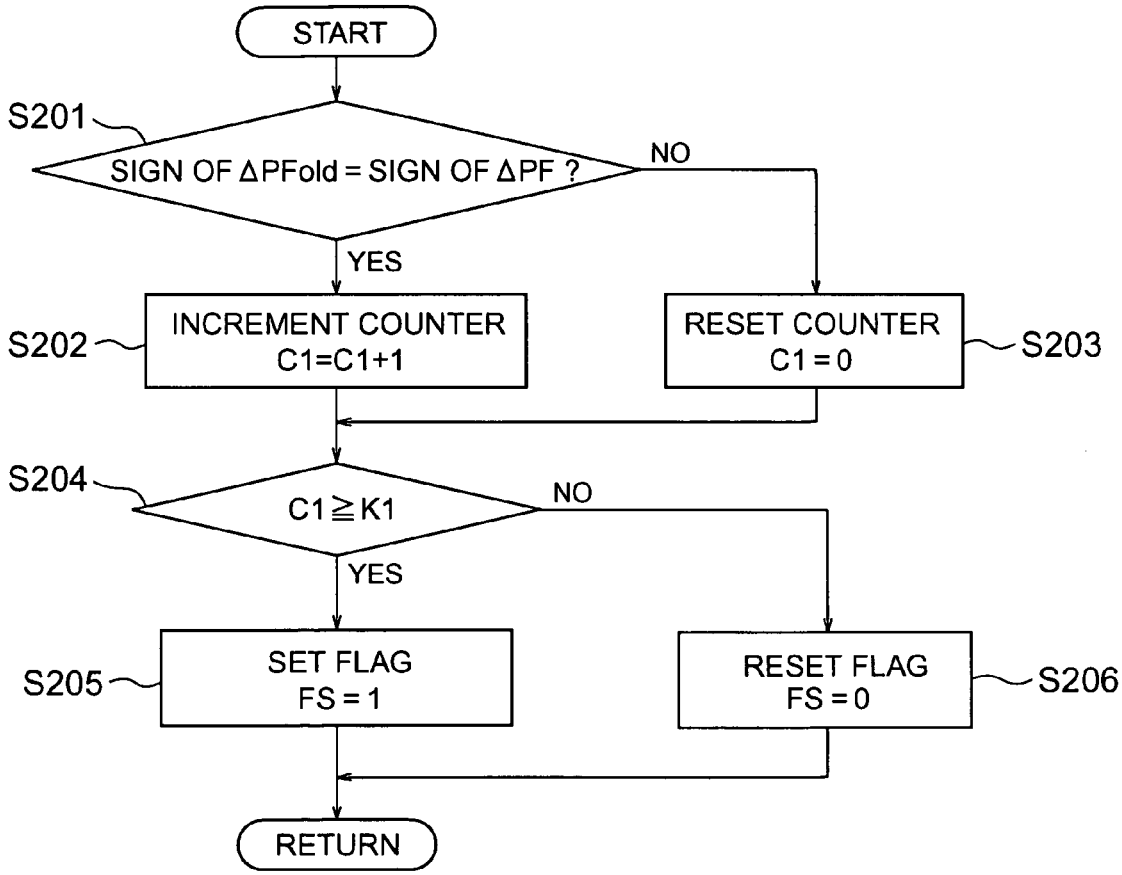
FIG. 5 is a flowchart showing processing for setting an integral operation update prohibition flag according to the first embodiment.

In FIG. 5, first, the integral operation update prohibiting means 605 judges whether the sign of the pressure deviation ΔPF calculated in Step S105 in FIG. 4 is identical with a sign of the last value ΔPFold of a pressure deviation calculated when the last arithmetic operation is executed (the sign of ΔPFold is the same as the sign of ΔPF) (whether the sign has inverted) (Step S201).

When it is judged in Step S201 that the sign of ΔPFold is the same as the sign of ΔPF (i.e., "YES" in Step S201), since the sign of the pressure deviation ΔPF has not inverted, the integral operation update prohibiting means 605 increments a value of the counter C1 to C1+1 (Step S202).

On the other hand, when it is judged in Step S201 that the sign of ΔPFold is not the same as the sign of ΔPF (i.e., "NO" in Step S201), since the sign of the pressure deviation ΔPF has inverted, the integral operation update prohibiting means 605 resets a value of the counter C1 to 0 (Step S203).

The integral operation update prohibiting means 605 judges whether a value of the counter C1 has reached the predetermined value K1 (Step S204). When it is judged that the value of the counter C1 is equal to or larger than K1 (i.e., "YES" in Step S204), since the predetermined period N1 in FIG. 3 has elapsed, the integral operation update prohibiting means 605 sets the integral operation update prohibition flag FS to 1 (Step S205) and exits from the processing routine of FIG. 5.

On the other hand, when it is judged in Step S204 that a value of the counter C1 is smaller than K1 (i.e., "NO" in Step S204), the integral operation update prohibiting means 605 resets the integral operation update prohibition flag FS to 0 (Step S206) and exits from the processing routine of FIG. 5.

The integral operation update prohibition flag FS is inputted to the feedback quantity calculating means 602. The integral arithmetic unit 623 executes processing for judging a state of the integral operation update prohibition flag FS (Step S107 in FIG. 4).

When the integral operation update prohibition flag FS is 0, the integral operand QFBI is updated (Step S108). When the integral operation update prohibition flag FS is 1, update of the integral operand QFBI is prohibited (Step S109). Subsequently, the processing in Steps S110 to S112 is executed.

As described above, the high-pressure fuel pump control device for an internal combustion engine according to the first embodiment includes the various sensors 62 and 63 that detect an operation state of the internal combustion engine 40, the high-pressure fuel pump 20 that pressurizes and discharges low-pressure fuel, which has been sucked, the flow control valve 10 that adjusts a fuel quantity discharged from the high-pressure fuel pump 20 when the drive timing TD is set, the accumulator 36 that accumulates pressure of the fuel discharged from the high-pressure fuel pump 20, the fuel injection valves 39 that inject and supply the fuel in the accumulator 36 to the respective combustion chambers of the internal combustion engine 40, the fuel pressure sensor 61 that detects the fuel pressure PF in the accumulator 36, the target pressure setting means 601 for setting the target pressure PO in the accumulator 36 on the basis of the operation state, the feedback quantity calculating means 602 for calculating the fuel discharge feedback quantity QFB of the high-pressure fuel pump 20 according to a proportional integral operation based on the pressure deviation ΔPF between the target pressure PO and the fuel pressure PF detected by the fuel pressure sensor 61, the flow control valve controlling means 603 for setting the drive timing TD of the flow control valve 10 on the basis of the target fuel discharge quantity QO calculated by adding up the fuel injection quantity QINJ of the fuel injected from the fuel injection valves 39 and the fuel discharge feedback quantity QFB, and the integral operation update prohibiting means 605.

The integral operation update prohibiting means 605 prohibits update of the integral operand QFBI in the fuel discharge feedback quantity QFB when the number of times of calculation of the fuel discharge feedback quantity QFB has reached the first predetermined number of times K1 (equivalent to the period N1) while a sign of the pressure deviation ΔPF does not invert. After that, when the sign of the pressure deviation ΔPF inverts, the integral operation update prohibition means 605 resumes update of the integral operand QFBI.

Accordingly, at the time of feedback control for adjusting the pressure deviation ΔPF between the target pressure PO and the fuel pressure PF in the accumulator 39 to be zero, it is possible to surely prevent overshoot or undershoot of the fuel pressure PF from occurring because an excessive increase or decrease in the integral operand QFBI or update of the integral operand QFBI in an inappropriate value is prohibited. This makes it possible to prevent deterioration in a combustion state or an exhaust gas of the internal combustion engine 40.

Second Embodiment

In the first embodiment, when the number of times of calculation of the fuel discharge feedback quantity QFB has reached the first predetermined number of times (the predetermined period N1) while the sign of the pressure deviation ΔPF does not invert, update of the integral operand QFBI in the fuel discharge feedback quantity QFB is prohibited and, after that, when the sign of the pressure deviation ΔPF inverts, update of the integral operand QFBI is resumed. However, when the number of times of calculation of the fuel discharge feedback quantity QFB has reached a second predetermined number of times (a predetermined period N2>N1) while the sign of the pressure deviation ΔPF does not invert at all from a point when update of the integral operand QFBI is prohibited, update of the integral operand QFBI may be resumed even if the sign of the pressure deviation ΔPF does not invert.

Hereinafter, a high-pressure fuel pump control device for an internal combustion engine according to a second embodiment of the present invention will be explained with reference to FIGS. 6 to 9 together with FIGS. 1 and 2.

A schematic constitution of the high-pressure fuel pump control device and a control function of the ECU 60 according to the second embodiment are the same as those explained above with reference to FIGS. 1 and 2. Thus, explanations of the schematic constitution and the control function are omitted. The explanation will be made by placing a focus only on a functional operation added to the integral operation update prohibiting means 605 in the ECU 60 characterizing the second embodiment.

If the number of times of arithmetic processing has reached the first predetermined number of times (the predetermined period N1) while a sign of the pressure deviation ΔPF inputted from the feedback quantity calculating means 602 does not invert, the number of times of calculation of the feedback quantity calculating means 602 reaches the second predetermined number of times (the predetermined period N2) while the sign of the pressure deviation ΔPF does not invert at all from a point when the integral operation update prohibition flag FS is set to 1 and update of the integral operand QFBI is prohibited. Then, the integral operation update prohibiting means 605 according to the second embodiment resets the integral operation update prohibition flag FS to "0" and resumes update of the integral operand QFBI even if the sign of the pressure deviation ΔPF has not inverted.

Figure 6:
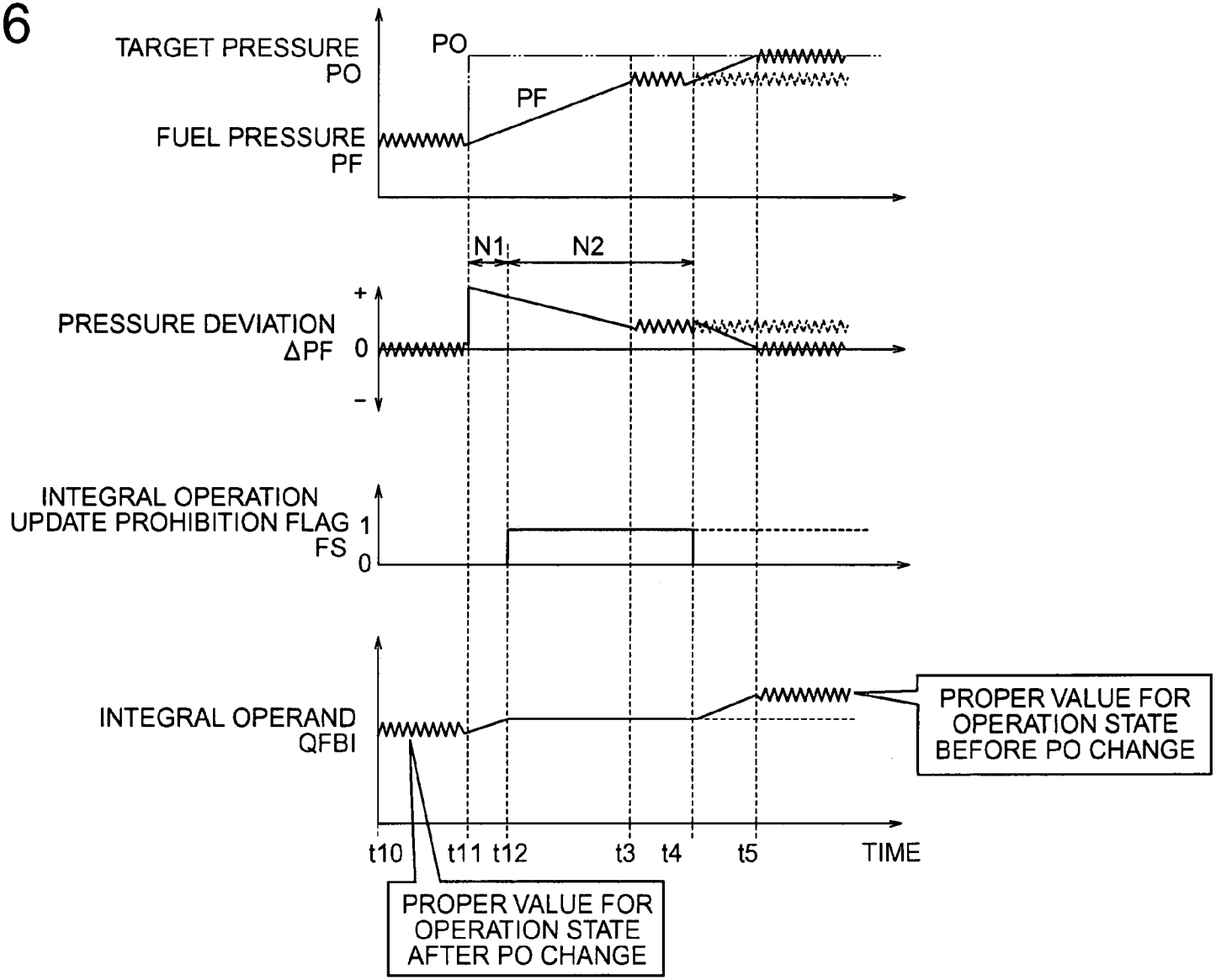
FIG. 6 is a timing chart for explaining a control operation according to the second embodiment.

FIG. 6 is a timing chart showing a setting operation for the integral operation update prohibition flag FS by the integral operation update prohibiting means 605 and a control operation by the integral arithmetic unit 623 according to the second embodiment.

In FIG. 6, the abscissa indicates elapse of time. Reference symbols t10 to t15 are given only to time positions that are key positions of the movements.

The period N1 indicated by the time t11 to t12 indicates, as in the above description (see FIG. 3), time required for executing an arithmetic operation for the fuel discharge feedback quantity QFB by the first predetermined number of times K1.

On the other hand, the period N2 indicated by the time t12 to t14 indicates time required for executing an arithmetic operation for the fuel discharge feedback quantity QFB by a second predetermined number of times K2 (>K1).

As described later, the second predetermined number of times K2 is set to different values corresponding to the pressure deviation ΔPF at a point (the time t12) when update of the integral operand QFBI is prohibited (see FIG. 8).

The ordinate in FIG. 6 indicates, as in the above description, in order from the one at the top, control states of the target pressure PO (an alternate long and two short dashes line) and the fuel pressure PF (a solid line), the pressure deviation ΔPF (=PO−PF), the integral operation update prohibition flag FS, and the integral operand QFBI.

Concerning the fuel pressure PF, the pressure deviation ΔPF, the integral operation update prohibition flag FS, and the integral operand QFBI in FIG. 6, movements at the time when only the first embodiment is applied thereto (when the second embodiment is not applied) are indicated by dotted lines. Movements at the time when the second embodiment is applied in addition to the first embodiment are indicated by solid lines.

In FIG. 6, first, in a period of the time t10 to t11, the fuel pressure PF is properly subjected to feedback control in a state in which the fuel pressure PF substantially coincides with the target pressure PO. Thus, a sign of the pressure deviation ΔPF (=PO−PF) repeats inversion of "+" and "−" in synchronization with the feedback control.

The integral operand QFBI is calculated by sequentially switching Expressions (2) and (3) in synchronization with the inversion of the sign of the pressure deviation ΔPF. In this state, the number of times of calculation for the fuel discharge feedback quantity QFB never reaches the first predetermined number of times K1 while the sign of the pressure deviation ΔPF does not invert.

Therefore, the integral operation update prohibition flag FS is never set to "1" in the period of the time t10 to t11.

As in the above description (the time t1 in FIG. 3), at the time t11, since the target pressure PO is changed to a large value, a large pressure deviation ΔPF with the "+sign" occurs between the target pressure PO changed and the fuel pressure PF. Therefore, immediately after the time t11, a state in which the pressure deviation ΔPF indicates the "+sign" lasts for a while.

Immediately after the time t11 when the target pressure PO is changed to the large value, the sign of the pressure deviation ΔPF changes to the "+sign" and Expression (2) is selected as arithmetic processing for the integral operand QFBI. Thus, although the integral operand QFBI starts an increase, at a point (the time t12) when it is judged that the number of times of calculation of the fuel discharge feedback quantity QFB has reached the first predetermined number of times K1 (in terms of time, the period N1 has elapsed) while the sign of the pressure deviation ΔPF does not invert from the "+sign" to the "−sign", the integral operation update prohibition flag FS is set to "1". Therefore, update of the integral operand QFBI is prohibited and the integral operand QFBI never increases excessively.

However, when a characteristic of a fuel discharge quantity of the high-pressure fuel pump 20 changes from a normal characteristic because of fluctuation in a characteristic of the flow control valve 10, abrasion of the cam 25, clogging of a fuel path connecting the low-pressure path 33 and the pressurizing chamber 23, or the like, update of the integral operand QFBI is prohibited in a state in which a value of the integral operand QFBI is not a proper value. Thus, it is likely that the fuel pressure PF does not reach the target pressure PO.

As a matter of fact, it is likely that, while a value of the integral operand QFBI at the point (the time t12) when update of the integral operand QFBI is prohibited is a proper value in an operation state before the time t11, the value is not an appropriate value for an operation state after the target pressure PO changes.

For example, as shown in FIG. 6, when a value of the integral operand QFBI at the point (the time t12) when update of the integral operand QFBI is prohibited is far smaller than the proper value for the operation state after the time t12, even if update of the integral operand QFBI is prohibited, the fuel pressure PF rises to a certain level because of the proportional operand QFBP. However, since the value of the integral operand QFBI in the update prohibited state is too small, for example, the fuel discharge feedback quantity QFB is insufficient at a point of the time t13. Thus, it is likely that the fuel pressure PF is saturated before the fuel pressure PF reaches the target pressure PO.

When only the control function of the integral operation update prohibiting means 605 according to the first embodiment is applied, the integral operation update prohibition flag FS is never reset to "0" until the sign of the pressure deviation ΔPF inverts.

Therefore, as indicated by dotted lines after the time t13, movements of the fuel pressure PF, the pressure deviation ΔPF, the integral operation update prohibition flag FS, and the integral operand QFBI keep a state in which update of the integral operand QFBI is not resumed.

Thus, in the second embodiment, at the time t14 when the number of times of calculation of the feedback quantity calculating means 602 has reached the second predetermined number of times K2 (<K1) (in terms of time, the period N2 has elapsed) from the point (the time t12) when update of the integral operand QFBI is prohibited, even if the sign of the pressure deviation ΔPF does not invert at all, the integral operation update prohibition flag FS is reset to "0" to resume update of the integral operand QFBI.

As a result, as in the movements of the fuel pressure PF, the pressure deviation ΔPF, the integral operation update prohibition flag FS, and the integral operand QFBI indicated by solid lines in a period of the time t14 to t15, update of the integral operand QFBI is resumed to increase the integral operand QFBI until the integral operand QFBI reaches a proper value (i.e., a value necessary for the fuel pressure PF to reach the target pressure PO). Thus, the fuel pressure PF and the target pressure PO coincide with each other.

Next, an operation for setting the second predetermined time K2 by the integral operation update prohibiting means 605 according to the second embodiment will be explained with reference to a timing chart of FIG. 7 and a diagram for explaining a K2 setting map of FIG. 8.

Figure 7:
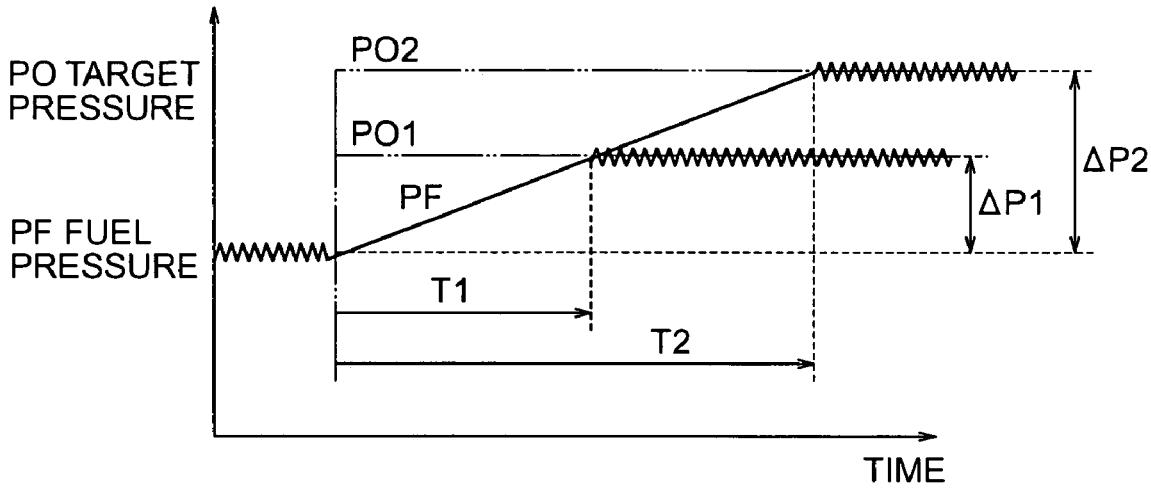
FIG. 7 is a timing chart for explaining a second predetermined number of times according to the second embodiment.

FIG. 7 shows a general feedback control characteristic. In FIG. 7, the abscissa indicates elapse of time and the ordinate indicates control states of the target pressure PO (an alternate long and two short dashes line) and the fuel pressure PF (a solid line).

Figure 8:
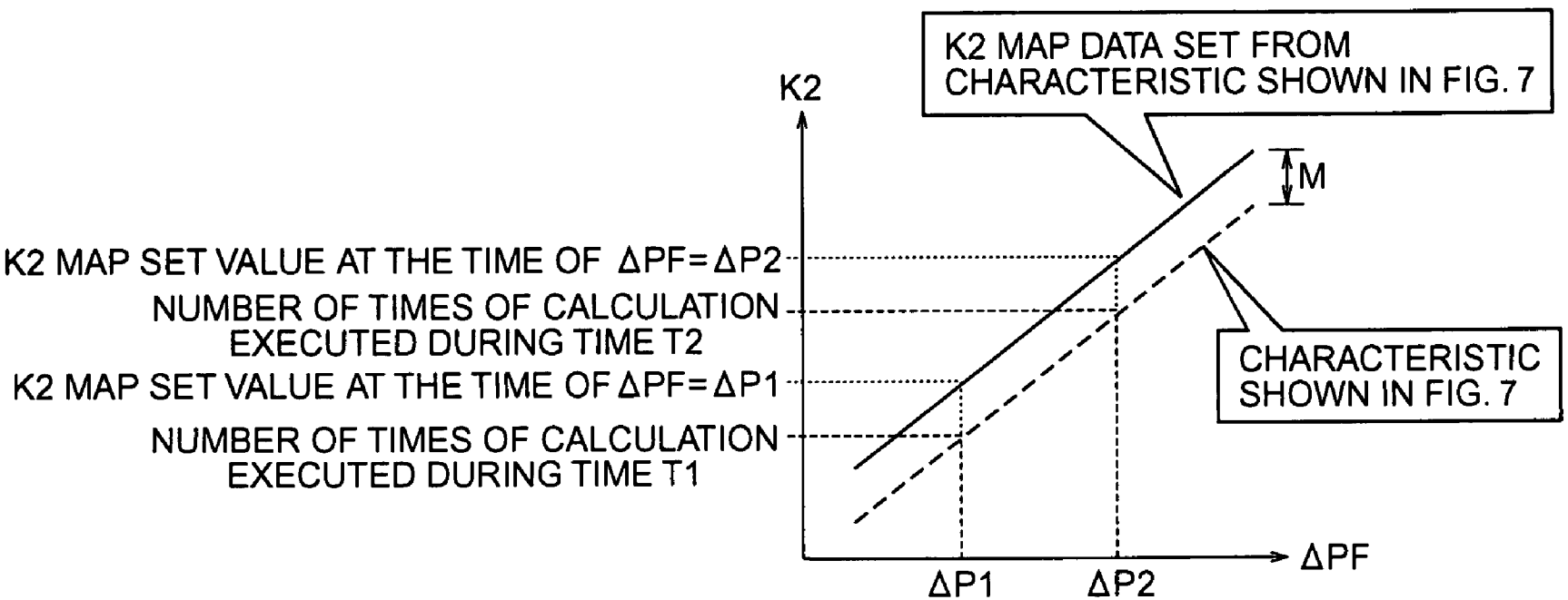
FIG. 8 is a graph for explaining map data for setting the second predetermined number of times according to the second embodiment.

FIG. 8 shows the control characteristic shown in FIG. 7 as a relation between the pressure deviation ΔPF and the number of times of calculation K2.

As is well known, in an appropriate feedback control state, as the pressure deviation ΔPF increases, time required for the fuel pressure PF to reach the target pressure PO becomes longer and a larger number of times of feedback operation is required. Such the feedback control characteristic is shown, for example, in FIG. 7.

When the target pressure PO changes to increase to a first target pressure PO1 and the pressure deviation ΔPF changes to a first pressure deviation ΔP1, time T1 is required for the fuel pressure PF to increase and coincide with the first target pressure PO1.

On the other hand, when the target pressure PO changes to increase to a second target pressure PO2 (>PO1) and the pressure deviation ΔPF changes to a second pressure deviation ΔP2 (>ΔP1), time T2 (>T1) is required for the fuel pressure PF to rise and coincide with the second target pressure PO2.

It is possible to represent the feedback control characteristic shown in FIG. 7 as indicated by a broken line characteristic shown in FIG. 8 when the feedback control characteristic is indicated as a relation between the pressure deviation ΔPF and the number of times of calculation K2.

Thus, in the second embodiment, the broken line characteristic shown in FIG. 8 is measured in advance as an experiment and the K2 setting map (see a solid line characteristic shown in FIG. 8) is stored in the ECU 60 on the basis of a characteristic value measured.

The K2 setting map indicated by the solid line shown in FIG. 8 is set as a value obtained by adding the predetermined number of times of calculation M to a relation between the pressure deviation ΔPF and the number of times of calculation (a broken line characteristic based on FIG. 7) measured in advance as an experiment.

As a result, the number of times of calculation K2 with which an update prohibition period of the integral operand QFBI is not unnecessarily prolonged is appropriately set according to the pressure deviation ΔPF. Even when the fuel pressure PF does not coincide with the target pressure PO because update of the integral operand QFBI is prohibited at an improper value, it is possible to quickly resume update of the integral operand QFBI.

Processing for setting the integral operation update prohibition flag FS (used in the judging step S107) by the integral operation update prohibiting means 605 according to the second embodiment will be specifically explained with reference to a flowchart of FIG. 9.

In this case, the integral operation update prohibiting means 605 has a counter C2 for measuring duration (corresponding to the number of times of calculation K2) of a state in which the sign of the pressure deviation ΔPF does not invert.

Figure 9:
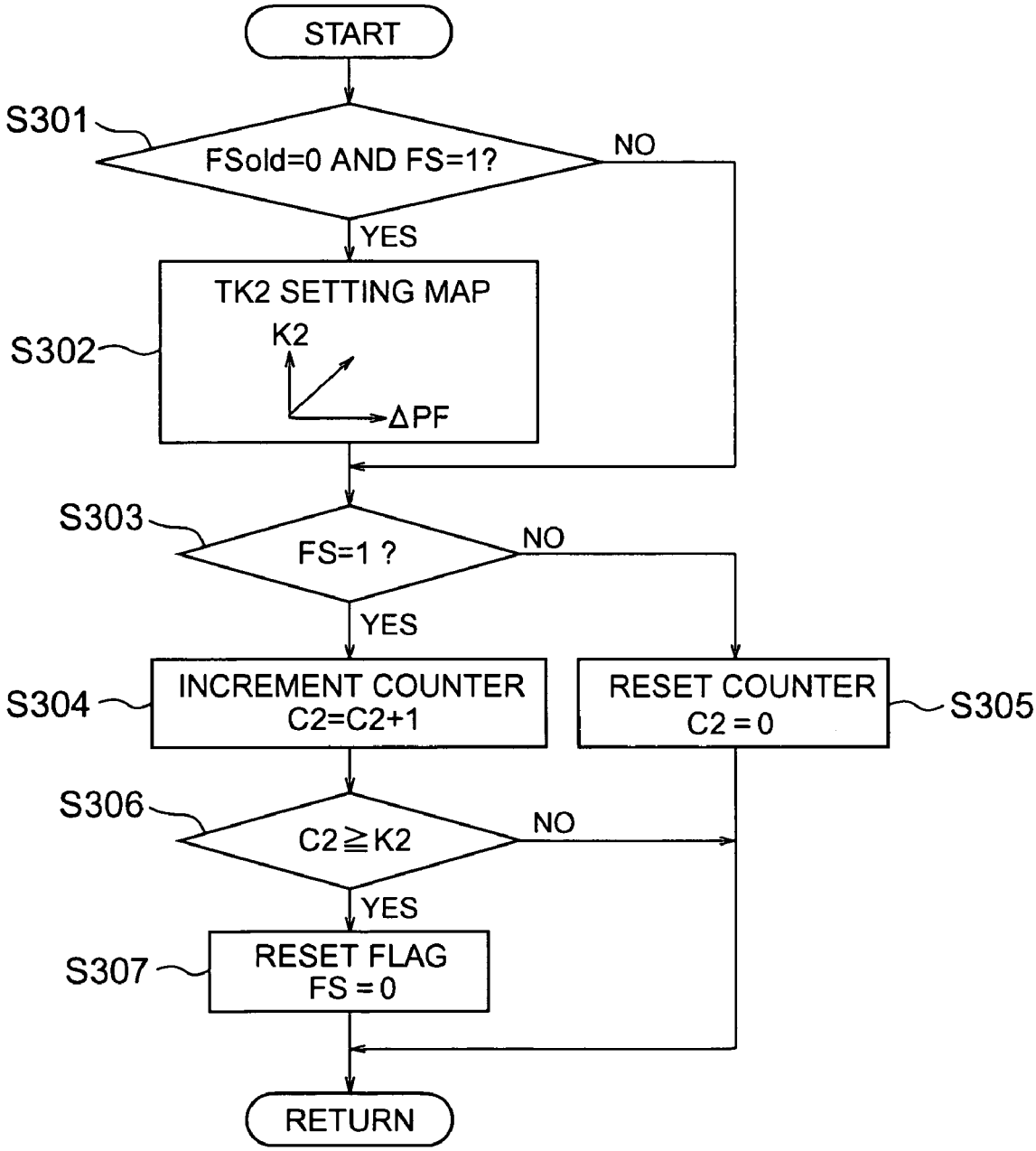
FIG. 9 is a flowchart showing processing for setting an integral operation update prohibition flag according to the second embodiment.

In FIG. 9, the integral operation update prohibiting means 605 first judges whether the last value FSold of the integral operation update prohibition flag FS set at the time of the last execution of an arithmetic operation in the flowchart of FIG. 5 is "0" and the integral operation update prohibition flag FS set at the time of the present execution is "1" (Step S301).

When it is judged in Step S301 that "FSold=0 and FS=1" (i.e., "YES" in Step S301), the integral operation update prohibiting means 605 determines the second predetermined number of times of calculation K2 corresponding to the pressure deviation ΔPF using the K2 setting map (map data indicated by the solid line characteristic shown in FIG. 8) (Step S302) and proceeds to the next judgment processing (Step S303).

On the other hand, when it is judged in Step S301 that "FSold≠0 or FS=0" (i.e., "NO" in Step S301), the integral operation update prohibiting means 605 immediately proceeds to Step S303.

Subsequently, in Step S303, the integral operation update prohibiting means 605 judges whether a state of the integral operation update prohibition flag FS is set to "1".

When it is judged in Step S303 that FS=1 (i.e., "YES" in Step S303), since update of the integral operand QFBI is prohibited, the integral operation update prohibiting means 605 increments a value of the Counter C2 to C2+1 (Step S304) and proceeds to the next judgment processing (Step S306).

When it is judged in Step S303 that FS=0 (i.e., "NO" in Step S303), since update of the integral operand QFBI is permitted, the integral operation update prohibiting means 605 resets a value of the counter C2 to 0 (Step S305) and immediately exits from the processing routine of FIG. 9.

On the other hand, in Step S306 following the increment processing of the counter C2 (Step S304), the integral operation update prohibiting means 605 judges whether a value of the counter C2 has reached the predetermined value K2.

When it is judged in Step S306 that C2=K2 (i.e., "YES" in Step S306), the integral operation update prohibiting means 605 resets the integral operation update prohibition flag FS to "0" (Step S307) and exits from the processing routine of FIG. 9.

On the other hand, when it is judged in Step S306 that C2<K2 (i.e., "NO" in Step S306), the integral operation update prohibiting means 605 immediately exits from the processing routine of FIG. 9.

Subsequently, the judgment processing for the integral operation update prohibition flag FS (Step S107 of FIG. 4) is executed.

When the integral operation update prohibition flag FS is 0, the integral operand QFBI is updated (Step S108 of FIG. 4). When the integral operand update prohibition flag FS is 1, update of the integral operand QFBI is prohibited (Step S109 of FIG. 4). Subsequently, the processing in Steps S110 to S112 of FIG. 4 is executed.

As described above, in the high-pressure fuel pump control device for an internal combustion engine according to the second embodiment, the integral operation update prohibiting means 605 resumes update of the integral operand QFBI when the number of times of calculation of the fuel discharge feedback quantity QFB has reached the first predetermined number of times K1 while the sign of the pressure deviation ΔPF does not invert and when the number of times of calculation of the fuel discharge feedback quantity QFBI has reached the second predetermined number of times K2 (equivalent to the period N2) while the sign of the pressure deviation ΔPF does not invert at all from the point when update of the integral operand QFBI is prohibited.

In response to the fact that the number of times of calculation of the fuel discharge feedback quantity QFBI has reached the first predetermined number of times K1 while the sign of the pressure deviation ΔPF does not invert, the second predetermined number of times K2 is set to different values corresponding to a magnitude of a pressure deviation at the point (the time t12) when update of the integral operand QFBI is prohibited.

As a result, in addition to the effect of the first embodiment, the number of times of calculation K2 with which an update prohibition period of the integral operand QFBI is not unnecessarily prolonged is appropriately set according to the pressure deviation ΔPF at a point when update of the integral operand QFBI is prohibited. Thus, even when the fuel pressure PF does not coincide with the target pressure PO because the integral operand QFBI is prohibited to be updated with an inappropriate value, it is possible to quickly resume update of the integral operand QFBI.

Third Embodiment

In the first and the second embodiments, the integral operation update prohibition flag FS is set on the basis of only the pressure deviation ΔPF. However, the integral operation update prohibition flag FS may be set with reference to not only the pressure deviation ΔPF but also the fuel pressure PF.

Hereinafter, a high-pressure fuel pump control device for an internal combustion engine according to a third embodiment of the present invention will be explained with reference to the drawings.

In this case, when a quantity of change in the fuel pressure PF in the accumulator 36 is not equal to or larger than a predetermined quantity in a period in which the number of times of calculation of the fuel discharge feedback quantity QFB elapses a third predetermined number of times K3 while a sign of the pressure deviation ΔPF does not invert, the integral operation update prohibiting means 605 in the ECU 60 judges that FS=1 and prohibits update of the integral operand QFBI in the fuel discharge feedback quantity QFB. After that, when the sign of the pressure deviation ΔPF inverts, the integral operation update prohibiting means 605 judges that FS=0 and resumes update of the integral operand QFBI.

A schematic constitution of the high-pressure fuel pump control device and a control function of the ECU 60 according to the third embodiment are as described above with reference to FIGS. 1 and 2. Thus, detailed descriptions of the schematic constitution and the control function are omitted. Only additional functional operations of the integral operation update prohibiting means 605, which characterize the third embodiment, will be explained.

The fuel pressure PF detected by the fuel pressure sensor 61 is additionally inputted to the integral operation update prohibiting means 605 according to the third embodiment. A function of setting the integral operation update prohibition flag FS based on the fuel pressure PF is provided in the integral operation update prohibiting means 605 in addition to the functions of the first and the second embodiments.

An operation for setting the integral operation update prohibition flag FS by the integral operation update prohibiting means 605 and a control operation by the integral arithmetic unit 623 according to the third embodiment will be explained with reference to a timing chart of FIG. 10 together with FIGS. 1 and 2.

Figure 10:
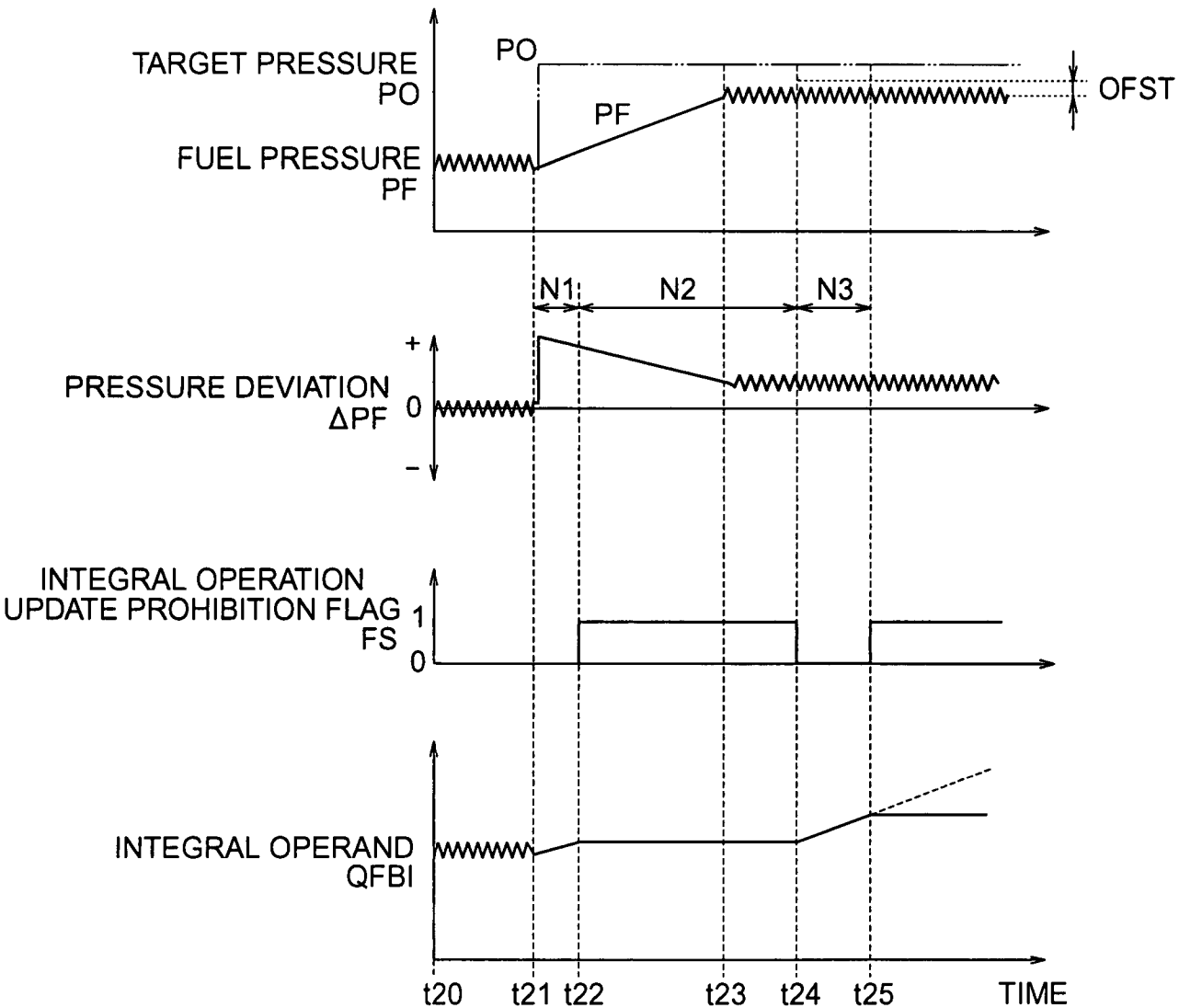
FIG. 10 is a timing chart for explaining a control operation according to the third embodiment.

In FIG. 10, the abscissa indicates elapse of time. Reference symbols t20 to t25 are given only to time positions that are key positions of the operations.

The period N1 indicated by the time t21 to t22 indicates, as in the above description (see FIGS. 3 and 6), time required for executing an arithmetic operation for the fuel discharge feedback quantity QFB by the first predetermined number of times K1. The period N2 indicated by the time t22 to t24 indicates time required for executing an arithmetic operation for the fuel discharge feedback quantity QFB by the second predetermined number of times K2 (>K1).

On the other hand, a period N3 indicated by the time t24 to t25 indicates time required for executing an arithmetic operation for the fuel discharge feedback quantity QFB by a third predetermined number of times K3.

The ordinates shown in FIG. 10 indicate, as described above, in order from the one at the top, control states of the target pressure PO (an alternate long and two short dashes line) and the fuel pressure PF (a solid line), the pressure deviation ΔPF (=PO−PF), the integral operation update prohibition flag FS, and the integral operand QFBI.

Moreover, concerning the integral operation update prohibition flag FS and the integral operand QFBI of FIG. 10, operations at the time when the third embodiment is applied are indicated by solid lines and operations at the time when the third embodiment is not applied are indicated by dotted lines.

In FIG. 10, first, in a period of the time t20 to t21, as described above, the fuel pressure PF is properly subjected to feedback control in a state in which the fuel pressure PF substantially coincides with the target pressure PO. Thus, the sign of the pressure deviation ΔPF (=PO-PF) repeats the inversion of "+" and "−" and in synchronization with the feedback control.

The integral operand QFBI is calculated by sequentially switching Expressions (2) and (3) in synchronization with the inversion of the sign of the pressure deviation ΔPF. In this state, the number of times of calculation of the fuel discharge feedback quantity QFB never reaches the first predetermined number of times K1 while the sign of the pressure deviation ΔPF does not invert.

Therefore, the integral operation update prohibition flag FS is never set to "1" in the period of the time t20 to t21.

As in the above description (the time t11 shown in FIG. 6), at the time t21, since the target pressure PO is changed to a large value, a large pressure deviation ΔPF with the "+sign" occurs between the target pressure PO changed and the fuel pressure PF. Therefore, immediately after the time t21, a state in which the pressure deviation ΔPF indicates the "+sign" lasts for a while.

Immediately after the time t21 when the target pressure PO is changed to the large value, the sign of the pressure deviation ΔPF changes to the "+sign" and Expression (2) is selected as arithmetic processing for the integral operand QFBI. Thus, although the integral operand QFBI starts an increase, at a point (the time t22) when it is judged that the number of times of calculation of the fuel discharge feedback quantity QFB has reached the first predetermined number of times K1 (in terms of time, the period N1 has elapsed) while the sign of the pressure deviation ΔPF does not invert from the "+sign" to the "−sign", the integral operation update prohibition flag FS is set to "1". Therefore, update of the integral operand QFBI is prohibited and the integral operand QFBI never increases excessively.

As in the above description (the time t13 shown in FIG. 6), when a rise in the fuel pressure PF is saturated at a point of the time t23, for example, as in the second embodiment, when the number of times of calculation of the feedback quantity calculating means 602 has reached the second predetermined number of times K2 (in terms of time, the period N2 has elapsed) from the point (the time t22) when update of the integral operand QFBI is prohibited, even if the sign of the pressure deviation ΔPF does not invert at all, at a point of the time t24, the integral operation update prohibition flag FS is reset to "0" to resume update of the integral operand QFBI. This makes it effective to shift the integral operand QFBI to a proper value.

However, even if update of the integral operand QFBI is resumed at the point of the time t24, it is likely that the rise in the fuel pressure PF is not resumed as indicated by movements of the fuel pressure PF and the pressure deviation ΔPF (see dotted lines after the time t24 shown in FIG. 10).

As an example of such the case, as described above, a characteristic of a fuel discharge quantity of the high-pressure fuel pump 20 falls below a normal characteristic because of fluctuation in a characteristic of the flow control valve 10, abrasion of the cam 25, clogging of a fuel path connecting the low-pressure path 33 and the pressurizing chamber 23, or the like.

As another example, in a transient state in which the internal combustion engine 40 transitions to a high-load operation, regardless of an increase in the fuel discharge feedback quantity QFB necessary for raising the fuel pressure PF, because of a large quantity of an increase in the fuel injection quantity QINJ, most of a fuel discharge quantity is consumed as the fuel injection quantity QINJ to increase time required for the fuel pressure PF to coincide with the target pressure PO.

In these cases, as indicated by dotted lines after the time t25 shown in FIG. 10, it is likely that the integral operand QFBI excessively increases after the resumption of update of the integral operand QFBI because a sign of the pressure deviation ΔPF is still the "+sign".

Thus, in the third embodiment, as indicated by the movements of the fuel pressure PF, the pressure deviation ΔPF, the integral operation update prohibition flag FS, and the integral operand QFBI indicated by the solid lines after the time t25 shown in FIG. 10, when a quantity of a change in the fuel pressure PF in a period in which the number of times of calculation of the feedback quantity calculating means 602 elapses by the third predetermined number of times K3 (in terms of time, the period N3 elapses) while the sign of the pressure deviation ΔPF does not invert is not equal to or larger than a predetermined quantity OFST, the integral operation update prohibition flag FS is set to "1" to prohibit update of the integral operand QFBI.

Although not shown in FIG. 10, after that, when the sign of the pressure deviation ΔPF inverts, the integral operation update prohibition flag FS is reset to "0" to resume update of the integral operand QFBI.

In this way, when the third embodiment is applied, regardless of whether a fuel discharge quantity of the high-pressure fuel pump 20 is near a maximum value, it is possible to prevent the integral operand QFBI at the time when the rise in the fuel pressure PF is saturated from increasing excessively.

Next, processing for setting the integral operation update prohibition flag FS (used in the judging step S107) by the integral operation update prohibiting means 605 according to the third embodiment will be specifically explained with reference to a flowchart of FIG. 11 together with FIG. 2.

In this case, the integral operation update prohibiting means 605 includes a counter C3 for measuring duration (corresponding to the third number of times of calculation K3) in a state in which a sign of the pressure deviation ΔPF does not invert and a memory MEM that temporarily stores a present value of the fuel pressure PF at the time when the sign of the pressure deviation ΔPF inverts.

Figure 11:
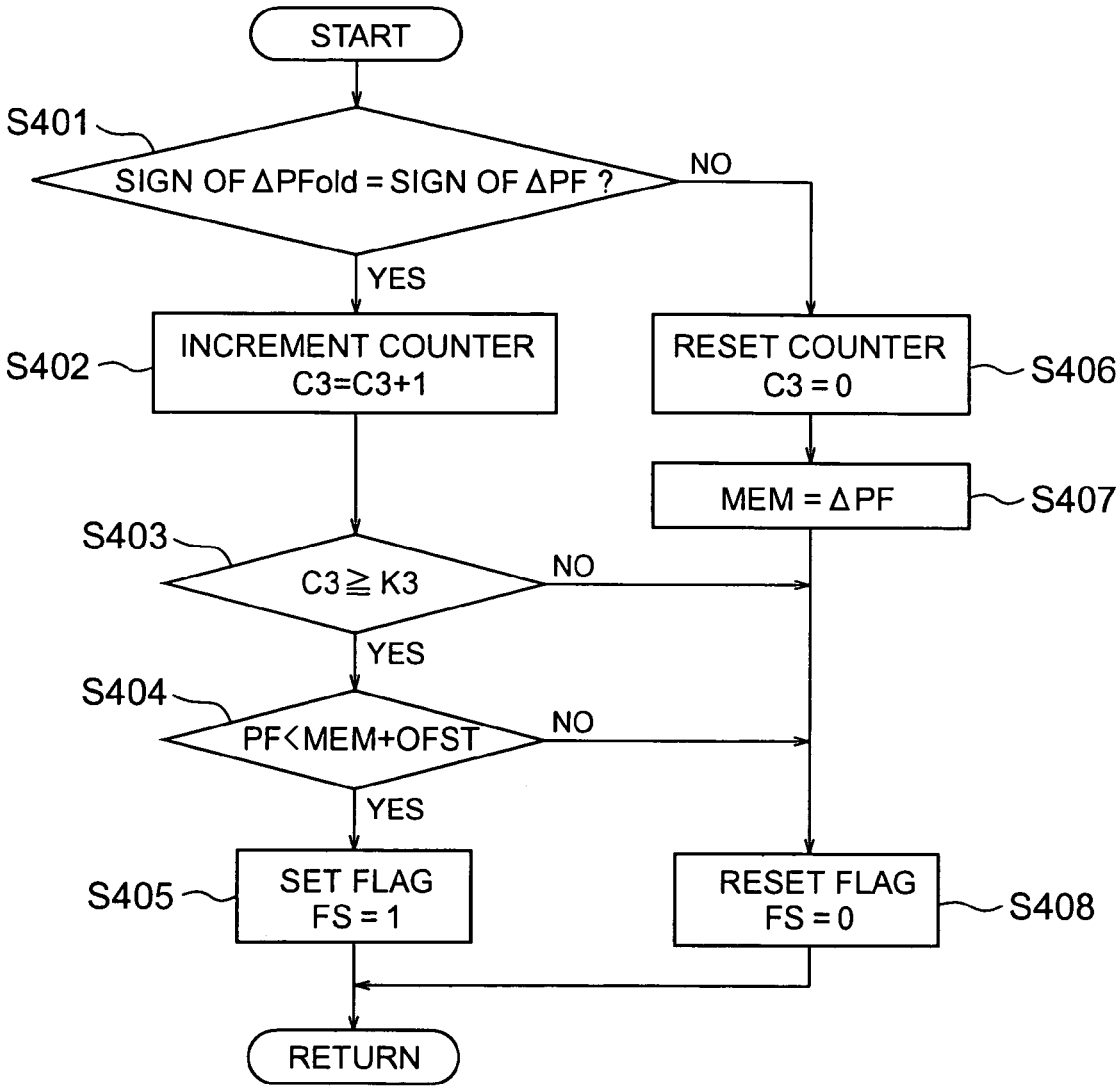
FIG. 11 is a flowchart showing processing for setting an integral operation update prohibition flag according to the third embodiment.

In FIG. 11, the integral operation update prohibiting means 605 first judges whether a sign of the pressure deviation ΔPF calculated this time in Step S105 of FIG. 4 is identical with (has inverted from) a sign of the last value of a pressure deviation ΔPFold calculated at the time of the last execution (Step S401).

If it is judged that "the sign of ΔPFold=the sign of ΔPF" (i.e., "YES" in Step S401), since the sign of the pressure deviation ΔPF has not inverted, the integral operation update prohibiting means 605 increments the counter C3 to C+1 (Step S402) and proceeds to the next judging processing (Step S403).

On the other hand, if it is judged in Step S401 that "the sign of ΔPFold≠the sign of ΔPF" (i.e., "NO" in Step S401), since the sign of the pressure deviation ΔPF has inverted, the integral operation update prohibiting means 605 resets the counter C3 to 0 (Step S406), temporarily stores a present value of the fuel pressure PF in the memory MEM (Step S407), resets the integral operation update prohibition flag FS to "0" (Step S408), and exits from the processing routine of FIG. 11.

In Step S403 following the increment processing of the counter C3 (Step S402), the integral operation update prohibiting means 605 judges whether a value of the counter C3 has reached the predetermined value K3.

When it is judged in Step S403 that C3=K3 (i.e., "YES" in Step S403), the integral operation update prohibiting means 605 considers that the third predetermined number of times K3 has elapsed while the sign of the pressure deviation ΔPF does not invert. The integral operation update prohibiting means 605 proceeds to the next judging processing (Step S404).

Moreover, when it is judged in Step S403 that C3<K3 (i.e., "NO" in Step S403), the integral operation update prohibiting means 605 proceeds to Step S408, resets the integral operation update prohibition flag FS to "0", and exits from the processing routine of FIG. 11.

On the other hand, when it is judged in Step S403 that C3=K3 (i.e., "YES" in Step S403), the integral operation update prohibiting means 605 judges whether the present value of the fuel pressure PF is smaller than a value obtained by adding a predetermined offset value OFST to the value temporarily stored in the memory MEM (the value of the pressure deviation ΔPF calculated the number of times of calculation K3 earlier) (MEM+OFST) (Step S404).

The offset value OFST is a value set in advance on the basis of a pressure change estimated to be an increase in the fuel pressure PF when the integral operand QFBI has increased by the third predetermined number of times K3.

When it is judged in Step S404 that PF<MEM+OFST (i.e., "YES" in Step S404), the integral operation update prohibiting means 605 considers that a quantity of change in the fuel pressure PF in a period in which the number of times of calculation of the feedback quantity calculating means 602 elapses by the third predetermined number of times K3 while the sign of the pressure deviation ΔPF does not invert is not equal to or larger than the offset value OFST (i.e., the increase in the integral operand QFBI is not reflected on the rise in the fuel pressure PF). The integral operation update prohibiting means 605 sets the integral operation update prohibition flag FS to "1" (Step S405) and exits from the processing routine of FIG. 11.

On the other hand, when it is judged in Step S404 that PF=MEM+OFST (i.e., "NO" in Step S404), the integral operation update prohibiting means 605 considers that a quantity of change in the fuel pressure PF in a period in which the number of times of calculation of the feedback quantity calculating means 602 elapses by the third predetermined number of times K3 while the sign of the pressure deviation ΔPF does not invert is equal to or larger than the offset value OFST (i.e., the fuel pressure PF rises according to the increase in the integral operand QFBI). The integral operation update prohibiting means 605 proceeds to Step S408, resets the integral operation update prohibition flag FS to "0", and exits from the processing routine of FIG. 11.

Subsequently, the processing for judging the integral operation update prohibition flag FS according to Step S107 shown in FIG. 4 is performed.

When the integral operation update prohibition flag FS is 0, the integral operand QFBI is updated (Step S108). When the integral operation update prohibition flag FS is 1, update of the integral operand QFBI is prohibited (Step S109). Subsequently, the processing of Steps S110 to S112 is executed.

In this way, when a quantity of change in the fuel pressure PF in the period N3 in which the number of times of calculation elapses by the third predetermined number of times K3 while the sign of the pressure deviation ΔPF does not invert is not equal to or larger than the predetermined quantity, the integral operation update prohibiting means 605 according to the third embodiment sets the integral operation update prohibition flag FS to "1" to prohibit update of the integral operand QFBI. After that, when the sign of the pressure deviation ΔPF inverts, the integral operation update prohibiting means 605 resets the integral operation update prohibition flag FS to "0" to resume update of the integral operand QFBI. Thus, in addition to the effect of the first embodiment, it is possible to prevent the integral operand QFBI at the time when the rise in the fuel pressure PF is saturated from increasing excessively regardless of whether a fuel discharge quantity of the high-pressure fuel pump 20 is near a maximum value.

In the explanation of the third embodiment, the third embodiment is combined with the constitutions of the first and the second embodiments. However, the integral operation update prohibiting means 605 may be provided in a high-pressure fuel pump control device for an internal combustion engine including the various sensors 62 and 63, the high-pressure fuel pump 20, the flow control valve 10, the accumulator 36, the fuel injection valves 39, the fuel pressure sensor 39, the target pressure setting means 601, the feedback quantity calculating means 602, and the flow control valve controlling means 603. When a quantity of change in the fuel pressure PF in the accumulator 36 in a period in which the number of times of calculation of the fuel discharge feedback quantity QFB elapses by the predetermined number of times K3 while a sign of the pressure deviation ΔPF does not invert is not equal to or larger than a predetermined quantity, the integral operation update prohibiting means 605 prohibits update of the integral operand QFBI in the fuel discharge feedback quantity QFB. After that, when the sign of the pressure deviation ΔPF inverts, the integral operation update prohibiting means 605 resumes update of the integral operand QFBI.

As a result, as described above, it is possible to prevent occurrence of overshoot or undershoot of the fuel pressure PF and it is possible to prevent the integral operand QFBI at the time when a rise in the fuel pressure PF is saturated from increasing excessively regardless of whether a fuel discharge quantity of the high-pressure fuel pump 20 is near a maximum value.

What is claimed is:

1. A high-pressure fuel pump control device for an internal combustion engine, characterized in that the device comprises:

various sensors for detecting an operation state of an internal combustion engine;

a high-pressure fuel pump for pressurizing and discharging low-pressure fuel, which has been sucked;

a flow control valve for adjusting a quantity of fuel discharged from the high-pressure fuel pump when drive timing is set;

an accumulator for accumulating a pressure of the fuel discharged from the high-pressure fuel pump;

fuel injection valves for injecting and supplying the fuel in the accumulator to respective combustion chambers of the internal combustion engine;

a fuel pressure sensor for detecting a fuel pressure in the accumulator;

target pressure setting means for setting a target pressure in the accumulator on the basis of the operation state;

feedback quantity calculating means for calculating a fuel discharge feedback quantity of the high-pressure fuel pump according to a proportional integral operation based on a pressure deviation between the target pressure and the fuel pressure detected by the fuel pressure sensor;

flow control valve controlling means for setting the drive timing of the flow control valve on the basis of a target fuel discharge quantity calculated by adding up a fuel injection quantity of the fuel injected from the fuel injection valve and the fuel discharge feedback quantity; and integral operation update prohibiting means, and in that the integral operation update prohibiting means prohibits, when a number of times of calculation of the fuel discharge feedback quantity reaches a first predetermined number of times while a sign of the pressure deviation does not invert, update of an integral operand in the fuel discharge feedback quantity, and resumes, when the sign of the pressure deviation inverts after that, the update of the integral operand.

2. A high-pressure fuel pump control device for an internal combustion engine according to claim 1, characterized in that the integral operation update prohibiting means resumes the update of the integral operand when the number of times of calculation of the fuel discharge feedback quantity reaches the first predetermined number of times while the sign of the pressure deviation does not invert and when the number of times of calculation of the fuel discharge feedback quantity reaches a second predetermined number of times while the sign of the pressure deviation does not invert at all from a point when the update of the integral operand is prohibited.

3. A high-pressure fuel pump control device for an internal combustion engine according to claim 2, characterized in that, in response to the number of times of calculation of the fuel discharge feedback quantity reaching the first predetermined number of times while the sign of the pressure deviation does not invert, the second predetermined number of times is set to a different value corresponding to a magnitude of the pressure deviation at a point when the update of the integral operand is prohibited.

4. A high-pressure fuel pump control device for an internal combustion engine according to any one of claims 1, characterized in that the integral operation update prohibiting means prohibits, when a quantity of change in the fuel pressure in the accumulator in a period in which the number of times of calculation of the fuel discharge feedback quantity elapses by a third predetermined number of times is not equal to or larger than a predetermined quantity, the update of the integral operand in the fuel discharge feedback quantity, and resumes, when the sign of the pressure deviation inverts after that, the update of the integral operand.

5. A high-pressure fuel pump control device for an internal combustion engine, characterized in that the device comprises:

various sensors for detecting an operation state of an internal combustion engine;

a high-pressure fuel pump for pressurizing and discharging low-pressure fuel, which has been sucked;

a flow control valve for adjusting a quantity of fuel discharged from the high-pressure fuel pump when drive timing is set;

an accumulator for accumulating a pressure of the fuel discharged from the high-pressure fuel pump;

fuel injection valves for injecting and supplying the fuel in the accumulator to respective combustion chambers of the internal combustion engine;

a fuel pressure sensor for detecting a fuel pressure in the accumulator;

target pressure setting means for setting a target pressure in the accumulator on the basis of the operation state;

feedback quantity calculating means for calculating a fuel discharge feedback quantity of the high-pressure fuel pump according to a proportional integral operation based on a pressure deviation between the target pressure and the fuel pressure detected by the fuel pressure sensor;

flow control valve controlling means for setting the drive timing of the flow control valve on the basis of a target fuel discharge quantity calculated by adding up a fuel injection quantity of the fuel injected from the fuel injection valve and the fuel discharge feedback quantity; and integral operation update prohibiting means, and in that the integral operation update prohibiting means prohibits, when a quantity of change in the fuel pressure in the accumulator in a period in which the number of times of calculation of the fuel discharge feedback quantity elapses by a third predetermined number of times is not equal to or larger than a predetermined quantity, update of an integral operand in the fuel discharge feedback quantity, and resumes, when the sign of the pressure deviation inverts after that, the update of the integral operand.

* * * * *